US007314159B2

(12) United States Patent
Rochefort et al.

(10) Patent No.: US 7,314,159 B2
(45) Date of Patent: Jan. 1, 2008

(54) QUADCORNER TRAY WRAPPER DESIGNS

(75) Inventors: Oscar Rochefort, Naperville, IL (US); Michael B. McLeod, Romeoville, IL (US)

(73) Assignee: Smurfit-Stone Container Enterprises, Inc., Chicago, IL (US)

( * ) Notice: Subject to any disclaimer, the term of this patent is extended or adjusted under 35 U.S.C. 154(b) by 0 days.

(21) Appl. No.: 10/286,159

(22) Filed: Nov. 1, 2002

(65) Prior Publication Data

US 2004/0084515 A1 May 6, 2004

(51) Int. Cl.
*B65D 5/00* (2006.01)

(52) U.S. Cl. ..... 229/147; 229/224; 229/103.2

(58) Field of Classification Search ..... 229/103.2, 229/147, 116.4, 127, 148, 922, 224, 190, 229/154; 53/456
See application file for complete search history.

(56) References Cited

U.S. PATENT DOCUMENTS

| | | | | |
|---|---|---|---|---|
| 880,410 | A | 2/1908 | Singer | |
| 914,809 | A | 3/1909 | Davis | |
| 1,014,951 | A | 1/1912 | Cornell | |
| 1,111,619 | A * | 9/1914 | Schrader | 229/117.05 |
| 1,143,103 | A | 6/1915 | Cameron | |
| 1,223,232 | A * | 4/1917 | Ash | 229/154 |
| RE16,936 | E | 4/1928 | Shafer | |
| 1,722,422 | A | 7/1929 | Johnson | |
| 1,863,260 | A * | 6/1932 | Van Buren | 229/154 |
| 1,953,896 | A | 4/1934 | Glass | |
| 2,122,654 | A | 7/1938 | Nickerson | |
| 2,201,462 | A | 5/1940 | Wells et al. | |
| 2,276,820 | A | 3/1942 | Bonfield | |
| 2,405,499 | A | 8/1946 | Guyer et al. | |
| 2,472,674 | A | 6/1949 | Morand | |
| 2,598,123 | A | 5/1952 | Hollinshead | |
| 2,603,404 | A * | 7/1952 | Eldredge | 229/103.2 |
| 2,652,970 | A | 9/1953 | George | |
| 2,801,783 | A | 8/1957 | Fink | |
| 2,847,154 | A | 8/1958 | Frankenstein | |
| 2,995,290 | A * | 8/1961 | Swanson et al. | 229/143 |
| 3,003,675 | A * | 10/1961 | Ringler | 229/152 |
| 3,007,376 | A | 11/1961 | Hickin et al. | |
| 3,019,959 | A * | 2/1962 | Skowronski | 229/224 |
| 3,162,350 | A | 12/1964 | Miller | |
| 3,197,110 | A | 7/1965 | Neuman et al. | |
| 3,203,613 | A | 8/1965 | Stowe | |
| 3,208,079 | A | 9/1965 | St. John | |
| 3,269,638 | A | 8/1966 | Forbes | |

(Continued)

FOREIGN PATENT DOCUMENTS

DE 295 328 A5 10/1991

(Continued)

*Primary Examiner*—Tri M. Mai
(74) *Attorney, Agent, or Firm*—Armstrong Teasdale LLP

(57) ABSTRACT

Containers of the wraparound and tray style are provided, having enhanced stacking strength and general robustness, through the provision of internal and external reinforcing panels and flanges. Variations of the basic invention are provided with closure flaps of varying configuration and placement; end walls and minor flaps with angled side edges to provide for containers having inclined sides; regions of weakness, removable portions of panels and/or preformed apertures to permit conversion of the containers to display/merchandising modes; gusseted corner structures to provide for containment of fluent materials; and enhanced transverse support structures.

13 Claims, 28 Drawing Sheets

U.S. PATENT DOCUMENTS

| | | | | |
|---|---|---|---|---|
| 3,356,282 | A | | 12/1967 | Layne, Sr. |
| 3,366,307 | A | | 1/1968 | Persson |
| 3,455,496 | A | | 7/1969 | Franz |
| 3,469,767 | A | | 9/1969 | Meyers |
| 3,533,549 | A | | 10/1970 | Gilchrist |
| 3,581,973 | A | | 6/1971 | Turpin |
| 3,586,233 | A | | 6/1971 | McCulloch |
| 3,756,499 | A | | 9/1973 | Giebel et al. |
| 3,801,000 | A | | 4/1974 | Hurley et al. |
| 3,815,809 | A | | 6/1974 | Walters |
| 3,825,174 | A | | 7/1974 | Booth, Jr. |
| 3,866,391 | A | | 2/1975 | Puskarz et al. |
| 3,933,300 | A | | 1/1976 | Dempster |
| 3,940,053 | A | | 2/1976 | Putman et al. |
| 3,985,287 | A | | 10/1976 | Stetler |
| 3,987,898 | A | | 10/1976 | Crane |
| 4,058,206 | A | | 11/1977 | Morse et al. |
| 4,126,285 | A | | 11/1978 | Spruill |
| 4,139,146 | A | | 2/1979 | Bamburg et al. |
| 4,159,076 | A | | 6/1979 | Engdahl, Jr. |
| 4,179,062 | A | | 12/1979 | Baker |
| 4,201,330 | A | | 5/1980 | Gilbert |
| 4,239,148 | A | | 12/1980 | Sorenson et al. |
| 4,257,550 | A | | 3/1981 | Frohlicher |
| 4,265,391 | A | | 5/1981 | Zornes et al. |
| 4,319,710 | A | | 3/1982 | Osborne |
| 4,350,281 | A | | 9/1982 | Dornbusch et al. |
| 4,488,675 | A | | 12/1984 | von Gnechten et al. |
| 4,542,847 | A | | 9/1985 | Lindstrom |
| 4,574,945 | A | | 3/1986 | Giblin |
| 4,605,128 | A | | 8/1986 | Rieke |
| 4,830,282 | A | | 5/1989 | Knight, Jr. |
| 4,986,466 | A | | 1/1991 | Colby |
| 5,007,580 | A | | 4/1991 | Morrison et al. |
| 5,125,567 | A | | 6/1992 | McClure |
| 5,139,195 | A | | 8/1992 | McClure |
| 5,282,567 | A | | 2/1994 | Dickson |
| 5,289,971 | A | | 3/1994 | McClure |
| 5,328,027 | A | | 7/1994 | Hollar et al. |
| 5,364,020 | A | | 11/1994 | Bansal |
| 5,372,269 | A | | 12/1994 | Sutton et al. |
| 5,398,869 | A | | 3/1995 | Dickson et al. |
| 5,476,218 | A | | 12/1995 | Reisman |
| 5,492,270 | A | | 2/1996 | Avery et al. |
| 5,495,983 | A | | 3/1996 | Lelek |
| 5,598,685 | A | | 2/1997 | Graham et al. |
| 5,853,120 | A | | 12/1998 | McLeod et al. |
| 5,855,973 | A | * | 1/1999 | Calvert et al. ..... 428/34.2 |
| 5,950,915 | A | | 9/1999 | Moen |
| 5,979,746 | A | * | 11/1999 | McLeod et al. ..... 229/120.09 |
| 6,092,716 | A | | 7/2000 | Smith |
| 6,216,871 | B1 | | 4/2001 | Bacques et al. |
| 6,234,385 | B1 | | 5/2001 | Espinoza et al. |
| 6,264,034 | B1 | | 7/2001 | Bacques et al. |
| 2001/0022319 | A1 | * | 9/2001 | Chevalier ..... 229/136 |
| 2001/0042783 | A1 | | 11/2001 | Jackson et al. |

FOREIGN PATENT DOCUMENTS

| | | | |
|---|---|---|---|
| FR | 1246891 | | 10/1960 |
| FR | 1357126 | | 2/1964 |
| FR | 1494492 | | 7/1967 |
| GB | 945089 | | 12/1963 |
| GB | 1471662 | | 4/1977 |
| GB | 2229426 | A | 9/1990 |
| SE | 116034 | | 3/1946 |

* cited by examiner 520c
520a
520b
538
518a
534
540
522
530
512
528
514
532
542
536
544

520a
538
518a
534
540
536
522
530
528
512
514
532
542

518a
534
538
520a
542

518a
534
536
522
530
514
524
532

534
538
518a
522
528
514
532
536
542

518a
538
526
512
514
542
536

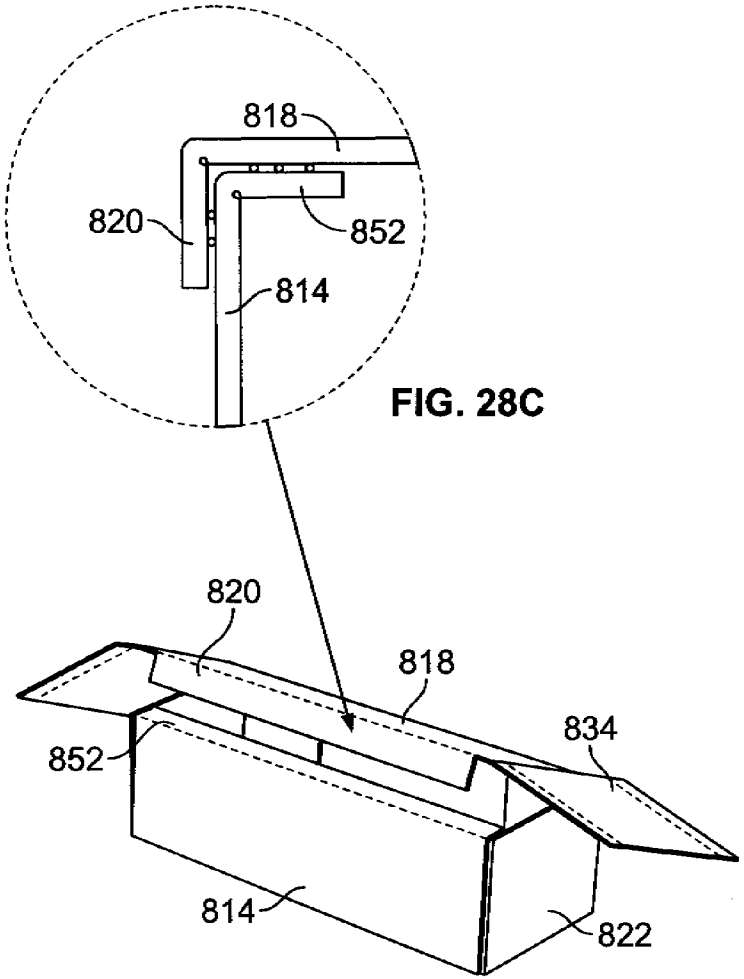
FIG. 28C
FIG. 28B
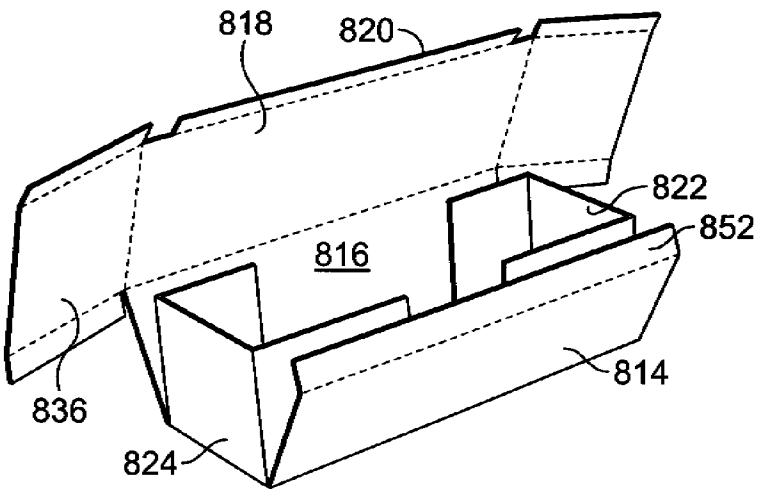
FIG. 28A

QUADCORNER TRAY WRAPPER DESIGNS

BACKGROUND OF THE INVENTION

1. Field of the Invention

The present invention relates to shipping containers, in particular shipping containers that are fabricated at least in part from paper, paperboard and/or corrugated paperboard material. The present invention also relates to such containers that are: 1) erected as a wraparound sheet around the group of products being packaged, with the group of products being placed on the blank forming the wrapper before articulation has begun, or at least well before articulation of the container has been completed; 2) erected as a tray, wherein the flat blank is formed into a tray container having the minor flaps adhered to the side panels; or 3) partially erected as a U-shaped receptacle form, wherein a group of products being packaged will be placed within the U-shaped form before the articulation of the minor flaps and the adhesion of the side panel combined with the articulation of the top panel and glue lap being adhesively affixed to the side panel.

2. The Prior Art

For various reasons, it is often desirable to provide a packaging system and resulting container, in which the blank from which the container is to be formed is either not yet articulated, or is only partially articulated, prior to placement of the goods to be packaged on or in the unformed or partially formed blank. Such containers are often referred to as wraps or wraparound cartons.

One such reason for such an approach, is when the goods to be packaged have a certain inherent stacking strength, such as nested canned goods, wherein the resultant wrap need not bear the entire load, when loaded ones of such cartons are stacked. In such constructions, the use of a wrap container configuration enables a minimum amount of container material to be used.

Interestingly, another environment in which wraparound style containers are used is when the goods to be contained are particularly fragile.

For example, it has become popular to package certain meat articles, which are generally known to be particularly perishable and prone to spoilage and contamination, in a vacuum-packed plastic bag, and then frozen, for shipment and storage. The vacuum-packed plastic bag closely follows the contours of the food item, so that no air is trapped. This helps prevent the occurrence of oxidation of the meat product, and generally improves the overall condition of the food product.

Unfortunately, some meat articles, particularly those still having the bone in place after processing (such as pork loins), are problematic to package in such vacuum-packed plastic bags. This is because the often rather sharp-edged bones in the food product have substantial potential for puncturing or cutting through the bag.

Due to such fragility, it is important to ensure that the food product is handled carefully, and packaged in a manner that is less likely to subject the package to stresses that might result in puncture of the bags, and thus contamination of the goods.

It has been found that the tray, tray wrapper or wraparound container is one of the more useful methods for addressing such a situation, because the goods (food product) is not pushed, lowered or dropped into an already substantially fully erected container. Instead the container is formed around the goods to be packaged.

However, unlike wrapper or wraparound containers for substantially self-supporting products like stacked cans, which permit the use of wraparound constructions of reduced material content, it is desirable to provide a wraparound container design that is more robust, without the use of excessive container material in the blank.

This and other desirable characteristics of the present invention will become apparent in view of the present specification and drawings.

SUMMARY OF THE INVENTION

The present invention comprises, in part, a tray, tray wrapper or wraparound style container for the packaging and shipment of articles, articulated from a single monolithically formed blank of container material.

The container comprises a bottom panel; a front panel emanating from a front edge region of the bottom panel; a rear panel emanating from a rear edge region of the bottom panel; a top panel emanating from a top edge region of the rear panel; first and second inside end panels emanating from end edge regions of the bottom panel; inner minor flaps emanating from front and rear edge regions of each of the first and second inside end panels; first and second outside end panels emanating from end edge regions of the top panel; outer reinforcement flanges emanating from front and rear edge regions of each of the first and second outside end panels; at least one closure flap emanating from at least one of the top panel and the front panel; whereupon articulation of the blank, the top and bottom panels are disposed in parallel, spaced relation to one another; the first and second inside end panels are juxtaposed to and parallel to the first and second outside end panels, respectively; the inner minor flaps are juxtaposed to the inside surfaces of the front and rear panels; and the outer reinforcement flanges are juxtaposed to the outside surfaces of the front and rear panels, for providing a container having reinforced corner regions for enhanced stacking strength.

In a preferred embodiment of the invention, the top and bottom panels are rectangular and have substantially the same dimensions.

In a preferred embodiment of the invention, the first and second inside end panels and the first and second outside end panels are rectangular and have substantially the same dimensions.

In a preferred embodiment of the invention, the at least one closure flap emanates from a forward edge region of the top panel, and upon articulation of the blank, is juxtaposed to an outside surface of an upper edge region of the front panel.

In a preferred embodiment of the invention, the at least one closure flap emanates from an upper edge region of the front panel, and upon articulation of the blank, is juxtaposed to an inside surface of a forward edge region of the top panel.

In a preferred embodiment of the invention, the outer reinforcement flanges have substantially less width than the inner minor flaps.

In a preferred embodiment of the invention, the inner minor flaps, when juxtaposed to the inner surfaces of the front and rear panels, have combined widths that are substantially less than the respective widths of the front and rear panels.

In a preferred embodiment of the invention, the inner minor flaps, when juxtaposed to the inside surfaces of the front and rear panels, have combined widths that are substantially the same as the respective widths of the front and rear panels.

In a preferred embodiment of the invention, the front and rear edge regions of each of the first and second inside end panels and the first and second outside end panels are inclined toward one another; and the inner minor flaps and the outer reinforcement flanges are non-rectangular and extend at non-orthogonal angles with respect to their respective first and second inside end panels and first and second outside end panels, so that, upon articulation of the blank, the first and second inside and outside end panels are inwardly inclined relative to the bottom panel, and the front and rear panels are inwardly inclined relative to the bottom panel, to form a frusto-pyramidal container.

The container may further comprise regions of weakness disposed along peripheral edge regions of the top panel, for enabling at least a portion of the top panel to be removed to provide access to an interior region of the container. The regions of weakness may comprise perforations extending along portions of front, rear and side edge regions of the top panel, and perforations extending diagonally along corner regions of the top panel, connecting the perforations extending along portions of front, rear and side edge regions of the top panel. The container may further comprise at least one access aperture disposed along at least one of a region of transition between the top panel and at least one closure flap emanating from a front edge region of the top panel, and a region of transition between the top panel and the rear panel.

In a preferred embodiment of the invention, the front panel has a height that is substantially less than the rear panel, for providing a front access opening in the container.

The container may further comprise at least one access aperture disposed along at least one of a region of transition between the top panel and at least one closure flap emanating from a front edge region of the top panel, and a region of transition between the top panel and the rear panel.

In a preferred embodiment of the invention, the inner minor flaps further emanate from end edge regions of the rear panel, and regions of foldable weakness are disposed substantially diagonally across at least a portion of each of the inner minor flaps, whereupon articulation of the blank, the inner minor flaps form inwardly folding gussets, providing a container having slotless bottom corner regions for facilitated leak-preventive containment of fluent material. The container may further comprise notches in each of the inner minor flaps extending from free edge regions thereof, inwardly toward and intersecting each of the regions of foldable weakness.

In a preferred embodiment of the invention, the at least one closure flap emanating from at least one of the top panel and the front panel comprises a closure flap emanating from a forward edge region of the top panel, which, upon articulation of the blank, is juxtaposed and adhesively affixed to an outside surface of an upper edge region of the front panel; and a closure flap emanating from an upper edge region of the front panel, which, upon articulation of the blank, is juxtaposed and adhesively affixed to an inside surface of a forward edge region of the top panel, thereby forming a transversely extending region of enhanced strength and rigidity along a forward upper edge region of the container.

The present invention also comprises, in part, a method for packaging at least one article, using a container, articulated from a single monolithically formed blank of container material, the method comprising the steps of:

providing a blank having a bottom panel;

a front panel emanating from a front edge region of the bottom panel;

a rear panel emanating from a rear edge region of the bottom panel;

a top panel emanating from a top edge region of the rear panel;

first and second inside end panels emanating from end edge regions of the bottom panel;

inner minor flaps emanating from front and rear edge regions of each of the first and second inside end panels;

first and second outside end panels emanating from end edge regions of the top panel;

outer reinforcement flanges emanating from front and rear edge regions of each of the first and second outside end panels;

at least one closure flap emanating from at least one of the top panel and the front panel;

positioning the at least one article to be packaged in overlying relation to the bottom panel of the blank;

folding the inner minor flaps to positions at least oblique with respect to their respective first and second inside end panels;

folding the first and second inside end panels to positions at least oblique with respect to the bottom panel;

folding the front panel to an upright position relative to the bottom panel;

folding the rear panel to an upright position relative to the bottom panel;

folding the top panel to a position substantially parallel to the bottom panel;

folding the first and second outside end panels to positions juxtaposed to and overlying the first and second inside end panels;

folding the outer reinforcement flanges to positions juxtaposed to and overlying the front and rear panels and affixing the outer reinforcement flanges thereto; and sealing the container by at least one closure flap to at least one of the front panel and the top panel.

The step of positioning the at least one article to be packaged in overlying relation to the bottom panel of the blank may be performed prior to the articulation of any of the panels of the blank. Alternatively, the step of positioning the at least one article to be packaged in overlying relation to the bottom panel of the blank may be performed, after the step of folding the inner minor flaps emanating from the rear edge regions of the first and second inside end panels, but prior to the step of folding the inner minor flaps emanating from the front edge regions of the firs and second inside end panels.

The method may further comprise the step of providing top and bottom panels that are rectangular and have substantially the same dimensions.

The method may further comprise the step of providing first and second inside end panels and first and second outside end panels that are trapezoidal and have substantially the same dimensions.

The method may further comprise the steps of providing at least one closure flap emanating from a forward edge region of the top panel, and juxtaposing the at least one closure flap to an outside surface of an upper edge region of the front panel.

The method may further comprise the steps of providing at least one closure flap emanating from an upper edge region of the front panel, and upon articulation of the blank and juxtaposing the at least one closure flap to an inside surface of a forward edge region of the top panel.

The method may further comprise the step of providing the outer reinforcement flanges with substantially less width than the inner minor flaps.

The method may further comprise the step of providing the inner minor flaps, when juxtaposed to the inner surfaces of the front and rear panels, with combined widths that are substantially less than the respective widths of the front and rear panels.

The method may further comprise the step of providing the inner minor flaps, when juxtaposed to the inside surfaces of the front and rear panels, with combined widths that are substantially the same as the respective widths of the front and rear panels.

The method may further comprise the steps of providing each of the first and second inside end panels and the first and second outside end panels with front and rear edge regions that are inclined toward one another; and of providing inner minor flaps and outer reinforcement flanges that are non-rectangular and extend at non-orthogonal angles with respect to their respective first and second inside end panels and first and second outside end panels, so that, upon articulation of the blank, the first and second inside and outside end panels are inwardly inclined relative to the bottom panel, and the front and rear panels are inwardly inclined relative to the bottom panel, to form a frusto-pyramidal container.

The method may further comprise the step of providing regions of weakness disposed along peripheral edge regions of the top panel, for enabling at least a portion of the top panel to be removed to provide access to an interior region of the container.

The step of providing regions of weakness may further comprise the step of providing perforations extending along portions of front, rear and side edge regions of the top panel, and perforations extending diagonally along corner regions of the top panel, connecting the perforations extending along portions of front, rear and side edge regions of the top panel.

The method may further comprise the step of providing at least one access aperture disposed along at least one of a region of transition between the top panel and at least one closure flap emanating from a front edge region of the top panel, and a region of transition between the top panel and the rear panel.

The method may further comprise the step of providing the front panel with a height that is substantially less than the rear panel, for providing a front access opening in the container.

The method may further comprise the step of providing at least one access aperture disposed along at least one of a region of transition between the top panel and at least one closure flap emanating from a front edge region of the top panel, and a region of transition between the top panel and the rear panel.

The method may further comprise the steps of providing inner minor flaps that emanate also from end edge regions of the rear panel, and of providing regions of foldable weakness that are disposed substantially diagonally across at least a portion of each of the inner minor flaps, whereupon articulation of the blank, the inner minor flaps form inwardly folding gussets, providing a container having slotless bottom corner regions for facilitated leak-preventive containment of fluent material.

The method may further comprise the step of providing notches in each of the inner minor flaps that extend from free edge regions thereof, inwardly toward and intersecting each of the regions of foldable weakness.

The method may further comprise the steps of:

providing a closure flap emanating from a forward edge region of the top panel, which, upon articulation of the blank, is juxtaposed and adhesively affixed to an outside surface of an upper edge region of the front panel; and providing a closure flap emanating from an upper edge region of the front panel, which, upon articulation of the blank, is juxtaposed and adhesively affixed to an inside surface of a forward edge region of the top panel, thereby forming a transversely extending region of enhanced strength and rigidity along a forward upper edge region of the container.

BRIEF DESCRIPTION OF THE DRAWINGS

FIG. 28A is a perspective view of a container according to the blank of FIG. 27.

FIG. 28B is a perspective view of the container of FIG. 27, further along the articulation process.

FIG. 28C is an enlarged cross-sectional view of a portion of the container of FIG. 27, showing the reinforced transverse closure seal that is formed upon full articulation of the container blank.

DETAILED DESCRIPTION OF THE DRAWINGS

Figure 1:
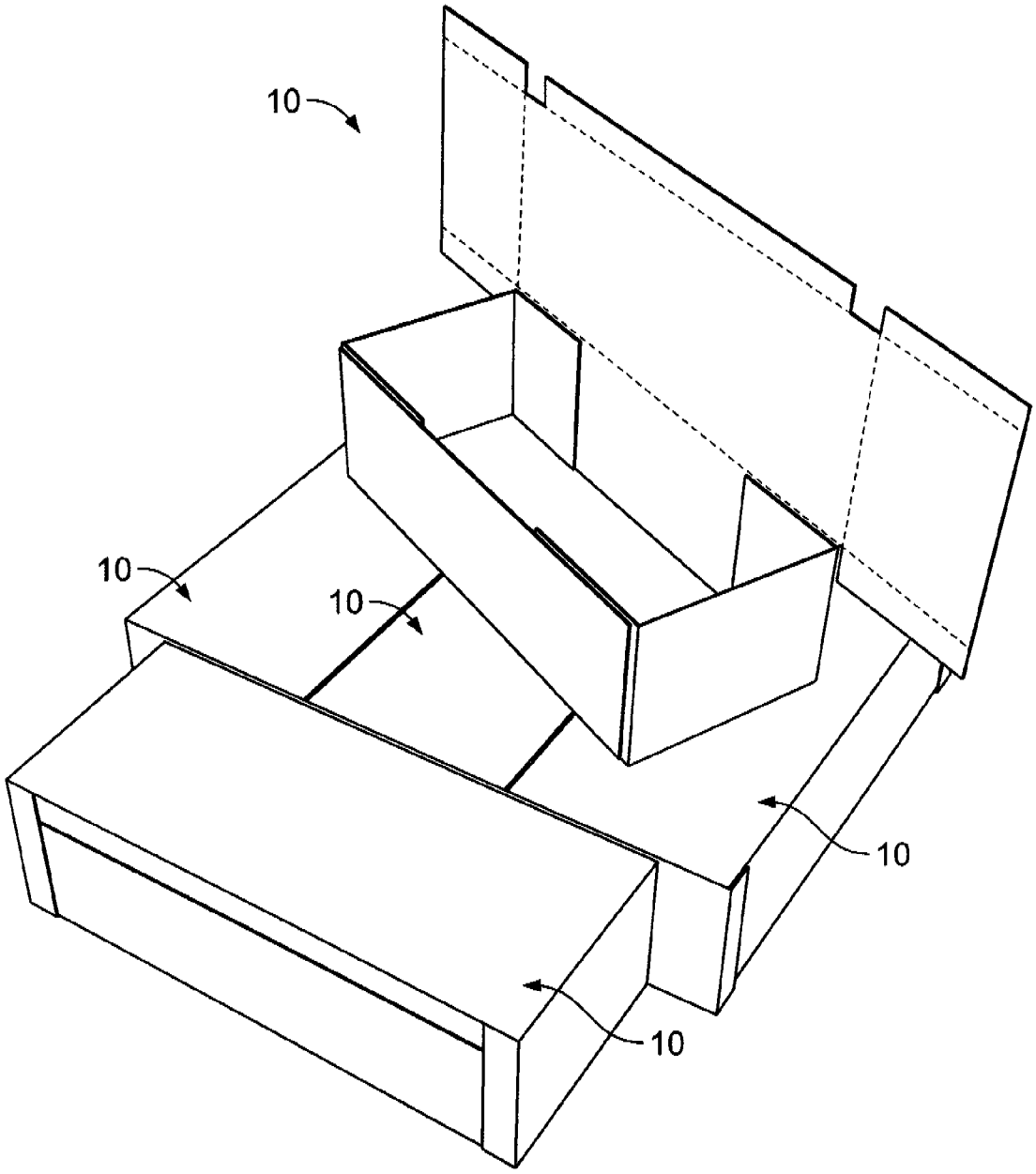
FIG. 1 is a perspective view of a quadcorner tray wrapper container according to one embodiment of the invention, shown in an open configuration, atop other containers of the same configuration.

While this invention is susceptible of embodiment in many different forms, there are shown in the drawings and will be described in detail, several specific embodiments, with the understanding that the present disclosure is to be considered as an exemplification of the principles of the invention and is not intended to limit the invention to the embodiments illustrated.

When referring to the plan illustrations of the blanks, the usual drawing conventions are applied. That is, unless otherwise noted, broken lines indicate fold lines; scalloped lines indicate lines of weakness forming a tear strip or similar structure; and interior solid lines indicate through-cuts.

In preferred embodiments of the invention, the blanks are fabricated from corrugated paperboard material, although other materials having similar suitable performance characteristics may be employed if desired.

The basic premise underlying the quadcorner tray wrapper designs of the present invention, is that of providing a wrapper type blank construction, in which the blank comprises four panels, consecutively arranged on the blank: top panel; rear (side) panel; bottom panel; and front (side) panel, contiguously connected along interpanel fold lines. Major flaps (end panels) emanate from the end edges of the top and bottom panels, each of which major flaps (end panels) are sized to cover the ends of the articulated carton. Minor flaps emanate from the leading and trailing edges of the major flaps. A closure tab emanates from a free edge of either the top or the front (i.e., the leading or trailing edges of the blank).

Upon articulation, the minor flaps emanating from the major (end) flaps of the bottom panel are folded to the inside of the front and rear panels, and form vertical supports for the container. The described minor flaps may or may not be adhered to the stated front and rear panels. If adhered, improved stacking strength can result. The interior folded (and adhered) minor flaps form vertical supports for the container. The front and rear (side) panels are then folded up perpendicular to the bottom panel. Within this phase of container articulation, adhesive can be dispensed to adhere the minor flaps juxtaposed to the front and rear panels. The top panel is then folded down parallel to the bottom panel and the extension from the top panel (closure tab or glue lap) is further folded down and adhered over the front panel and parallel to the front and rear panels. The major flaps (external end panels) emanating from the top panel are folded down over the major flaps (internal end panels) of the bottom panel and once juxtaposed are adhered to each other. The minor reinforcing flaps of the major flaps (external end panels) emanating from the top panel are folded and adhered to the outside of the front and rear panels. This creates a laminated and adhered triple thickness of container material along the end edge regions of the front and rear panels, as well as a laminated and adhered double thickness of material on the ends of the carton.

In a first variation of the general design (FIGS. 1-9), the width of the carton is considerably greater than the depth or height. The minor flaps are all each substantially less than one-half the width of the carton, so that there is a substantial gap between facing free edges of the minor flaps on the interior and exterior faces of the front and rear walls, thus creating "corner post" reinforcement structures, rather than complete end or side walls. The closure tab emanates from the free edge of the top panel, and is folded to be juxtaposed and adhesively affixed to the front panel.

Figure 2:
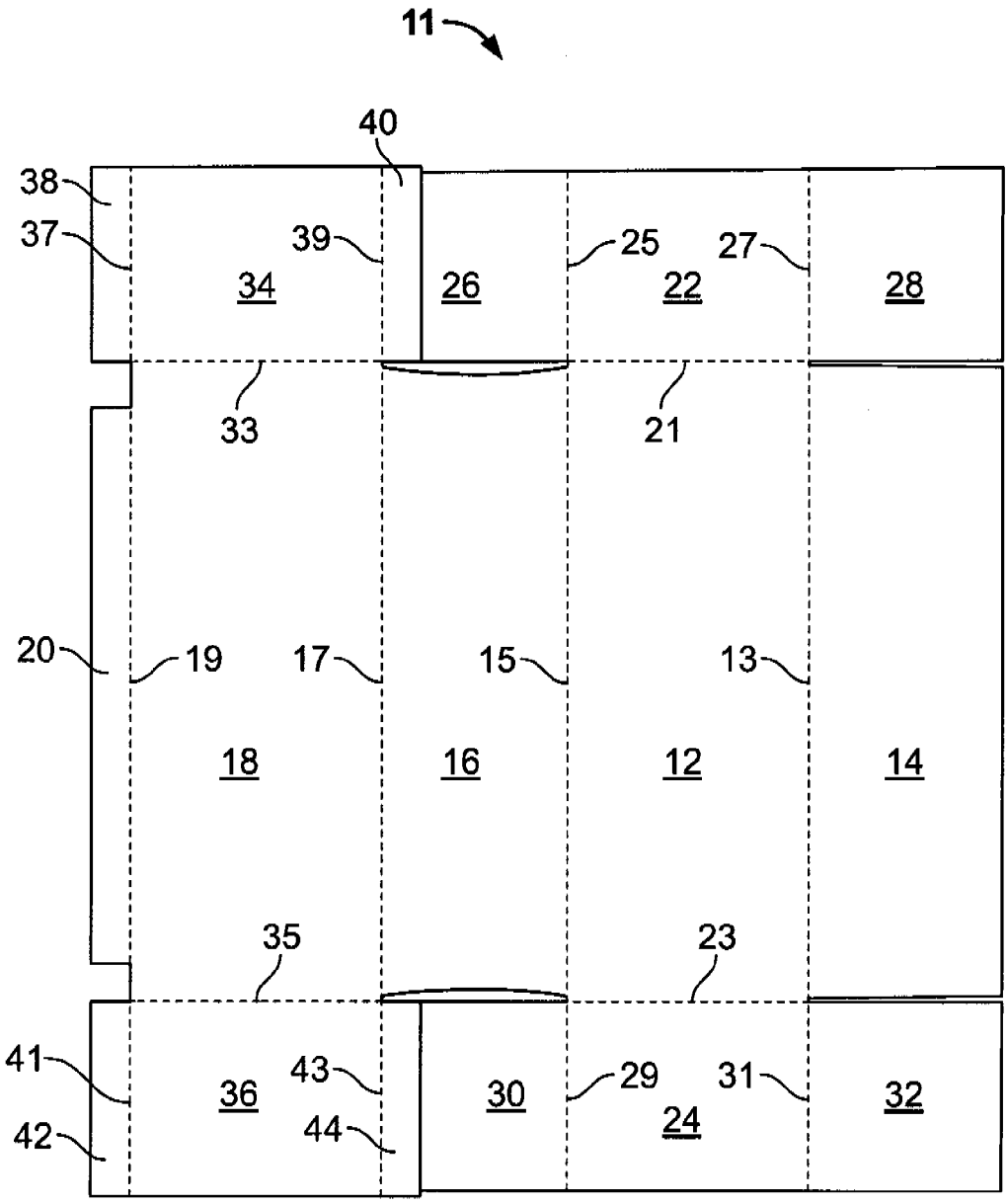
FIG. 2 is a plan view of a blank for forming the tray wrapper container according to the embodiment of FIG. 1.
Figure 3:
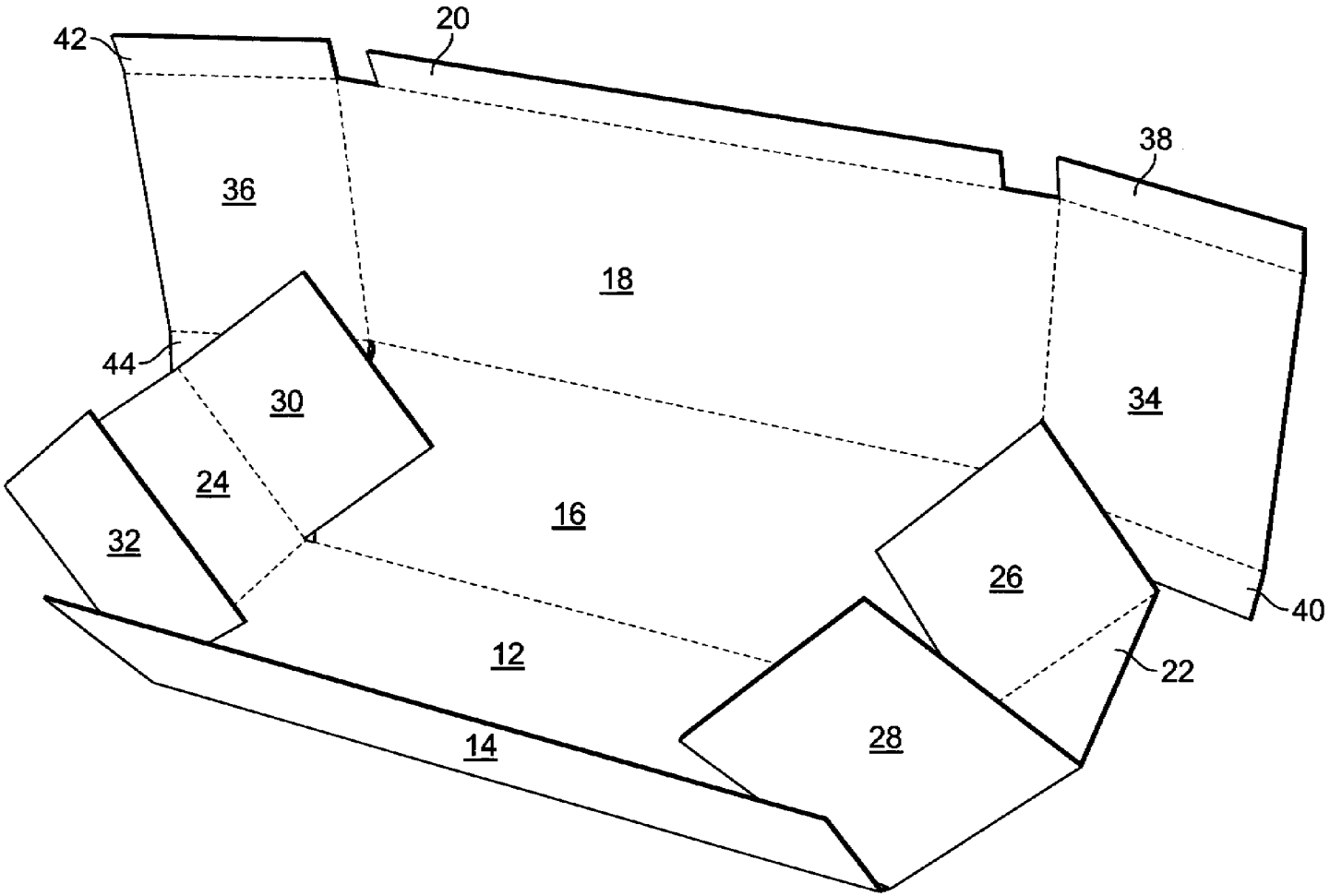
FIG. 3 is a perspective view of the blank of FIG. 2, at an early stage in the process of being articulated into a container, with the goods to be packaged being omitted from the illustration.
Figure 4:
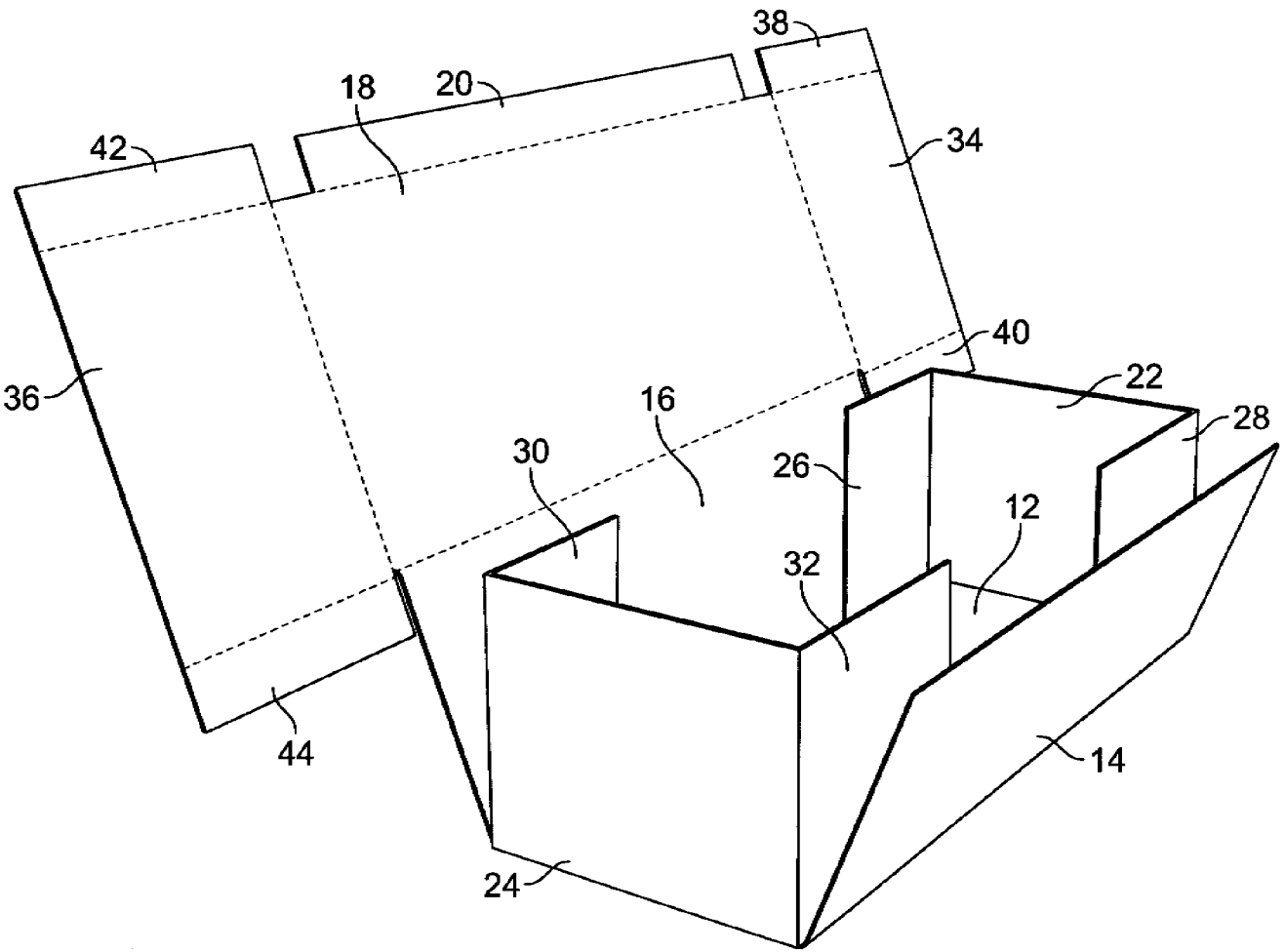
FIG. 4 is a perspective view of the blank of FIG. 2, at a later stage in the process of being articulated into a container, with the goods to be packaged being omitted from the illustration.
Figure 5:
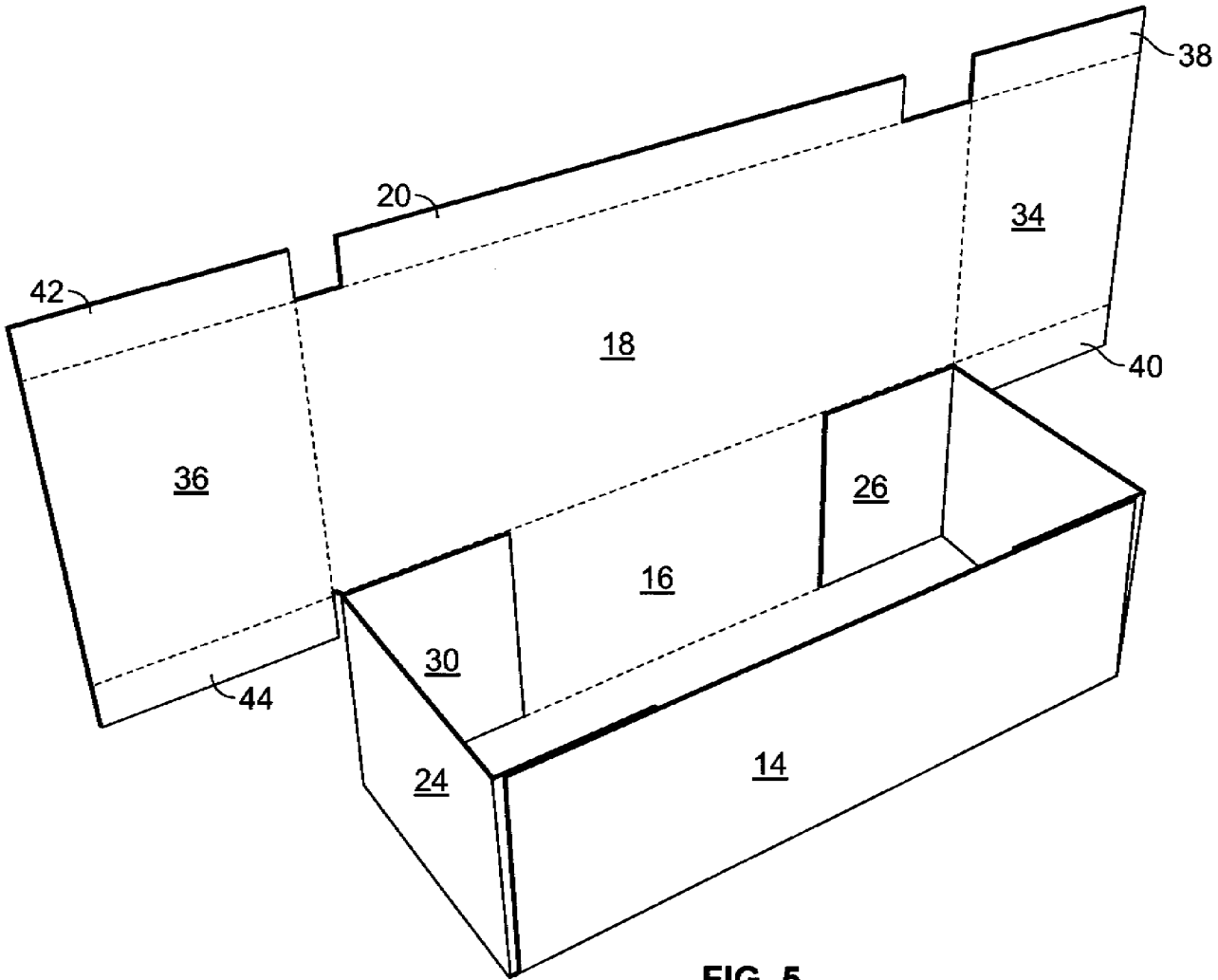
FIG. 5 is a perspective view of the container of FIG. 1, near the end of the process of articulation into a completed container, prior to closure of the container, with the goods to be packaged being omitted from the illustration.

Container 10 is formed from blank 11 (FIG. 2). Blank 11 includes bottom panel 12, front (side) panel 14, rear (side) panel 16, top panel 18 and closure flap 20; as well as fold lines 13, 15, 17 and 19. Blank 11 also includes inner end panels 22, 24 (emanating along fold lines 21, 23, respectively) from which interior minor flaps 26, 28, 30, 32 emanate along fold lines 25, 27, 29 and 31, respectively. Outer end panels 34, 36 emanate from top panel 18 along fold lines 33, 35, respectively. Reinforcing flanges 38, 40, 42, 44 emanate from outer end panels 34, 36, along fold lines 37, 39, 41 and 43, respectively. The end edges of panels 14 and 16 may be vertical. Alternatively, the end edges of rear panel 16 preferably may be concavely bowed and the end edges of front panel 14 preferably may be inwardly inclined from bottom to top (both as illustrated), because this style of slot configuration may permit ease of removing and ease of stripping the waste material from the designated and created aperture in the blank sheet. As an alternative, rather than the described designated slot, a singular cut including offsets as required may be implemented thereby eliminating a need to remove waste material.

Figure 6:
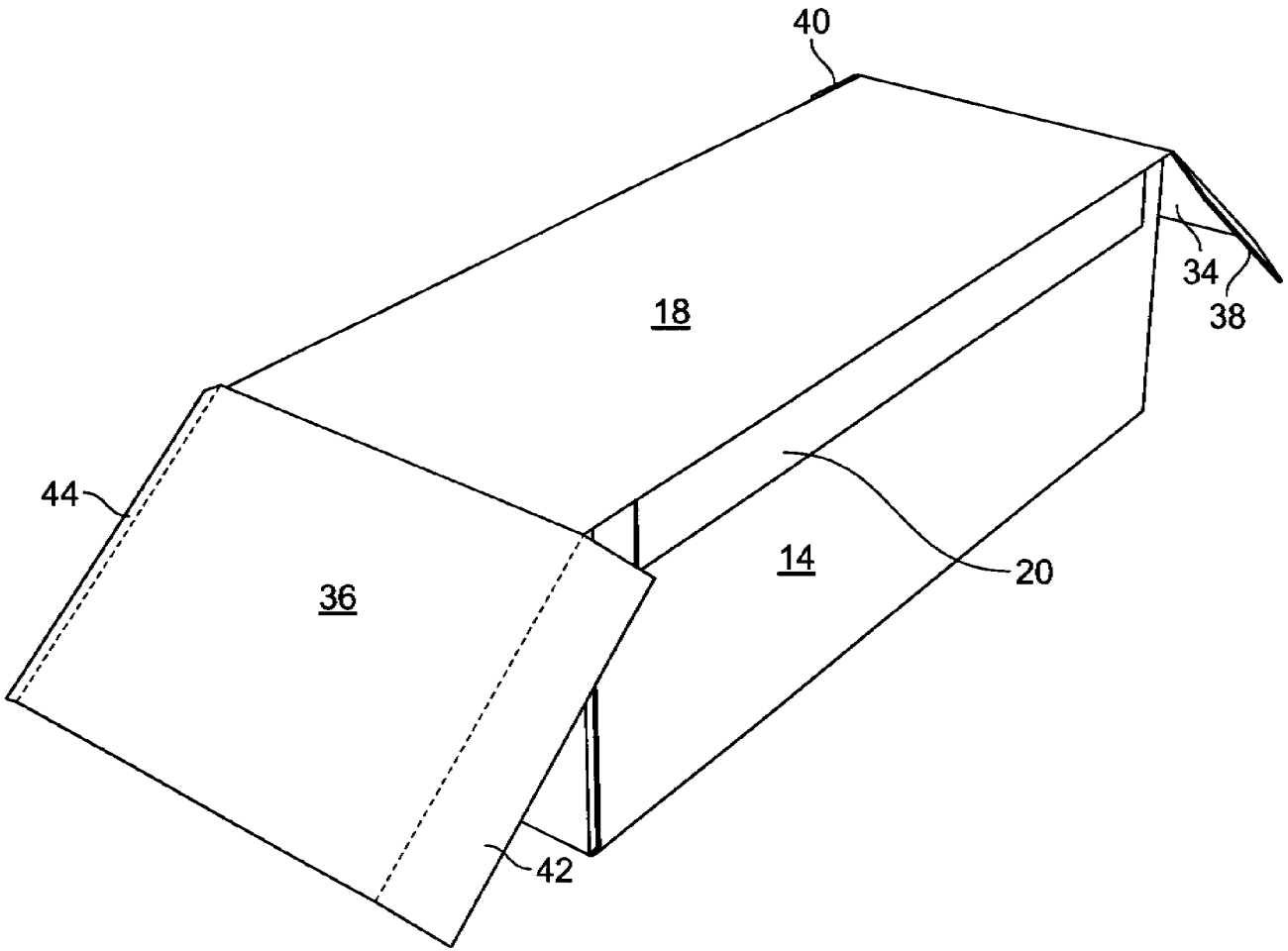
FIG. 6 is a perspective view of the container of FIG. 5, as the top panel is being brought into closure position, the major (outside) end flaps are being folded down, and the minor (reinforcing) flaps are being folded around to provide the final closure of the container.
Figure 7:
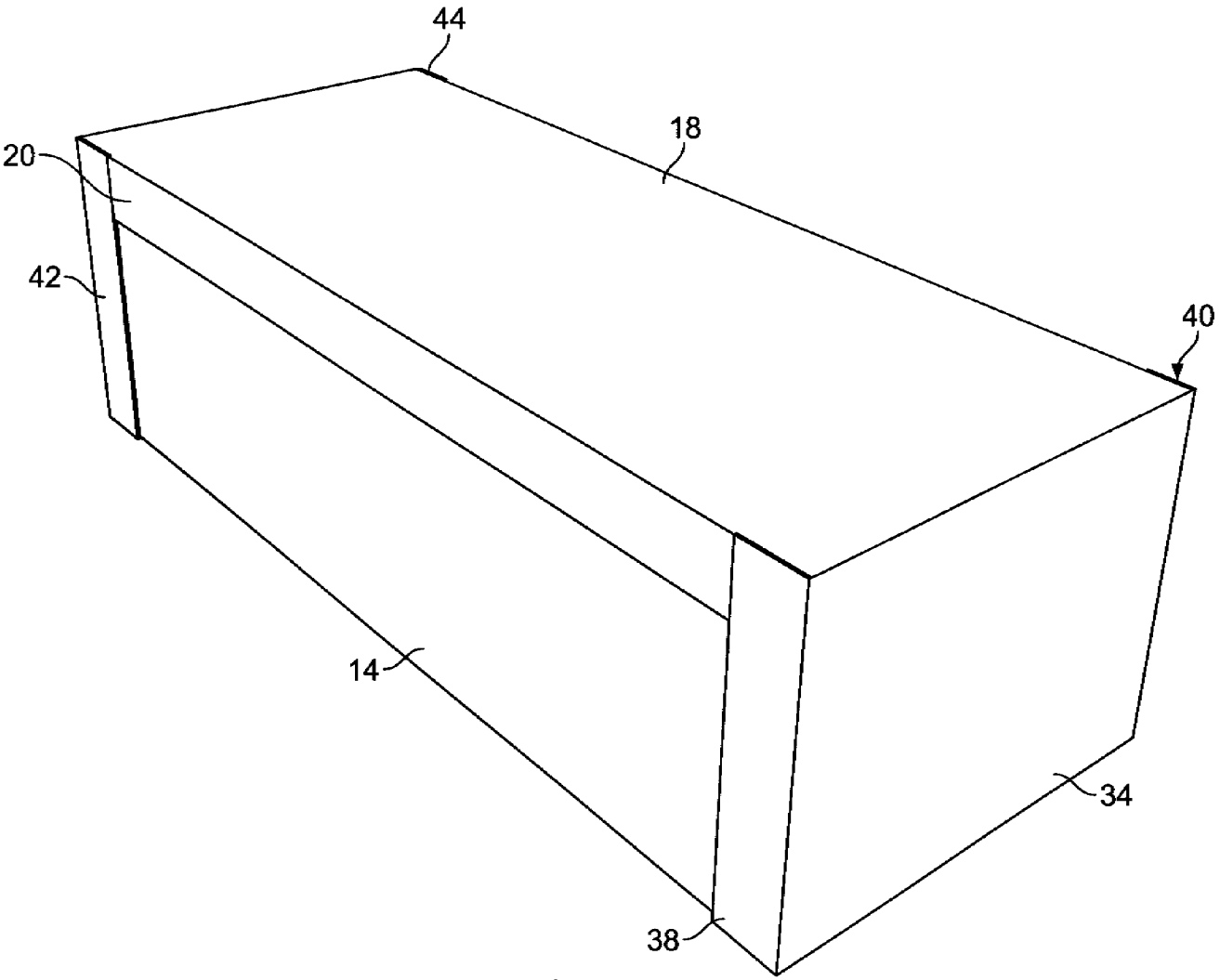
FIG. 7 is a perspective view of the container of FIGS. 1-6, in fully articulated, closed configuration.
Figure 8:
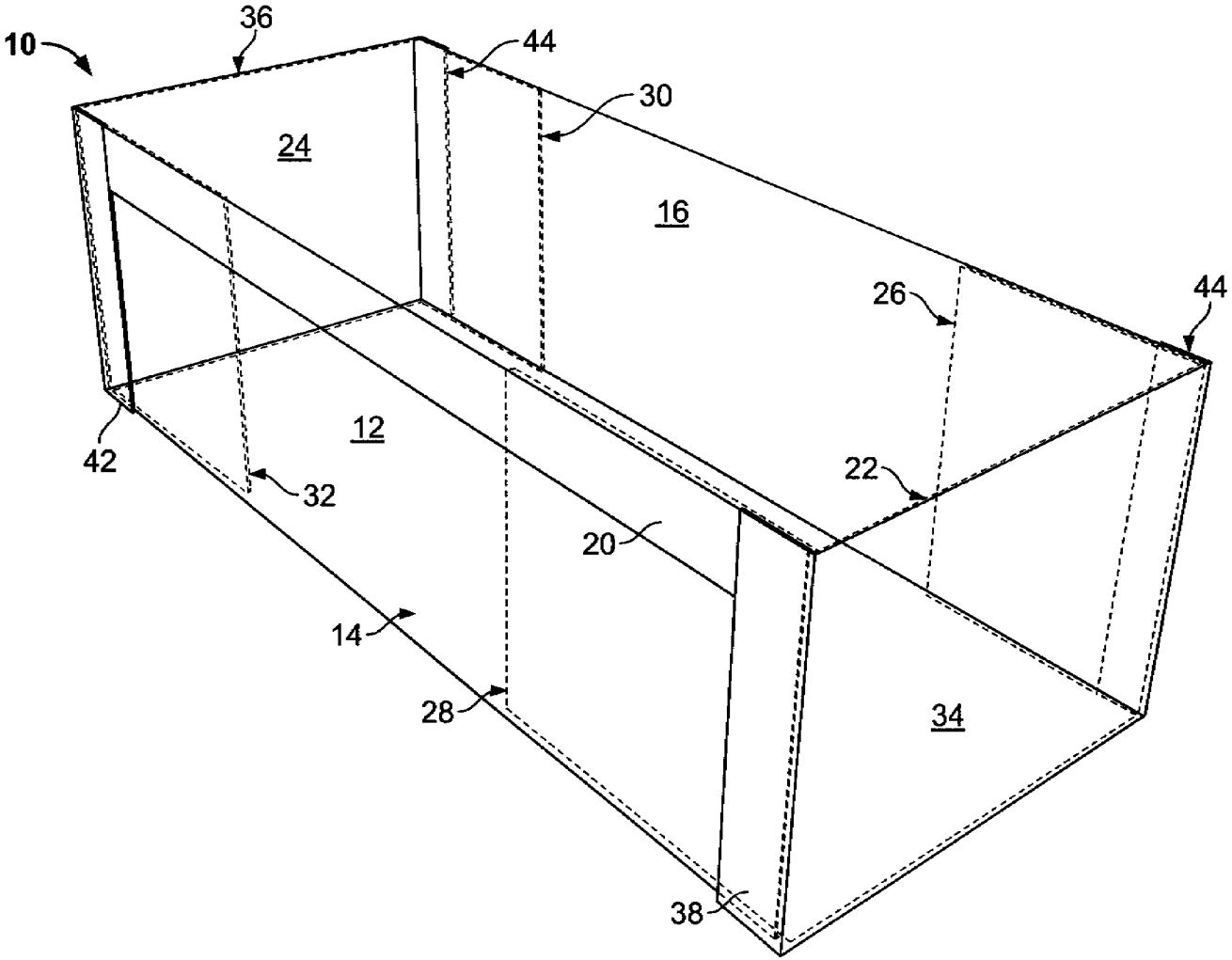
FIG. 8 is a perspective "transparent" view of the container of FIG. 7.
Figure 9:
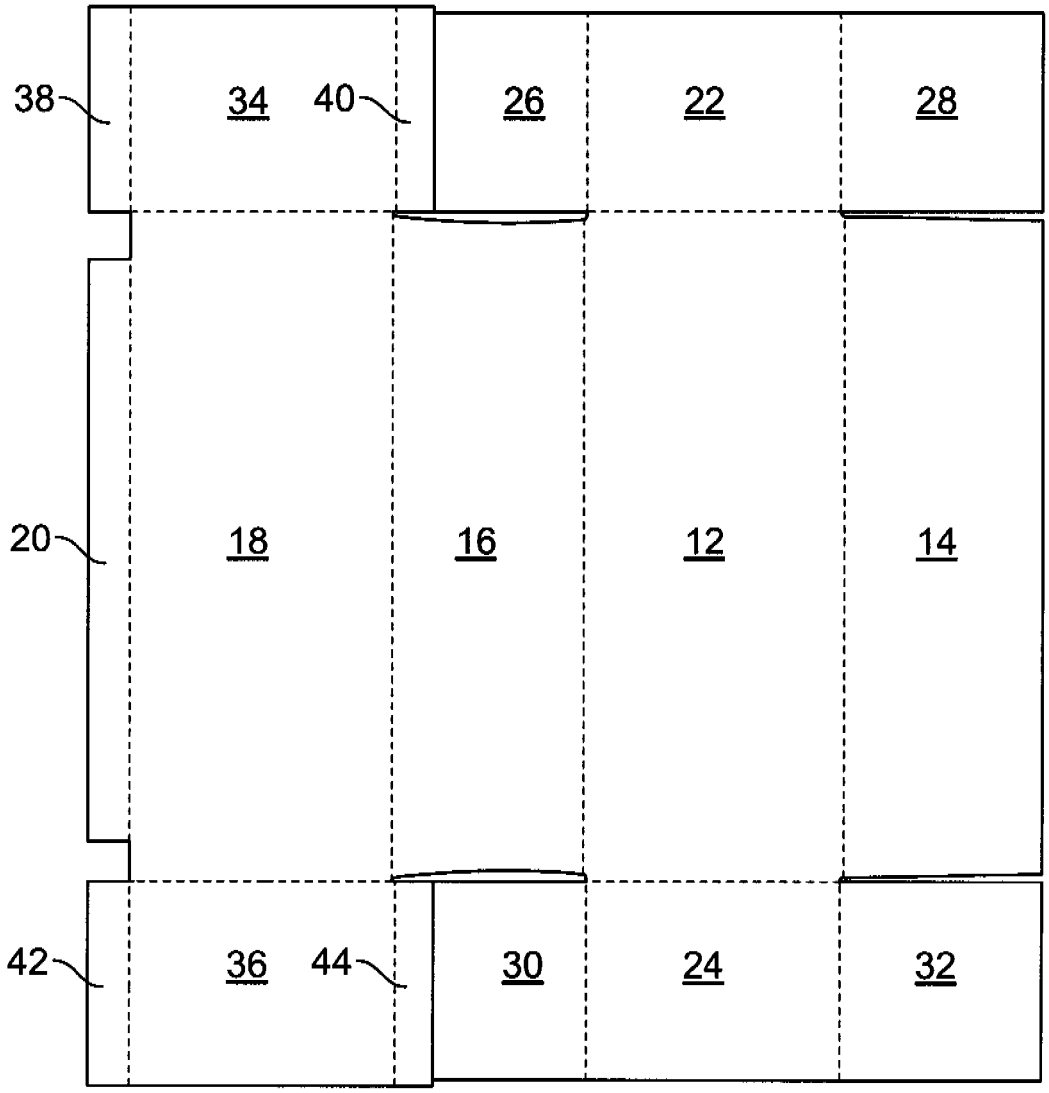
FIG. 9 is a further view of the blank of FIG. 2.

In a typical articulation procedure, first, the product to be contained will be pushed onto blank 11, which will be laid flat on a packaging apparatus. Flaps 30, 32 will be folded perpendicular to panel 24, and flaps 26, 28 will be folded perpendicular to panel 22. Panels 22, 24 will be folded upwardly perpendicularly to bottom panel 12. Rear (side) panel 16 and front (side) panel 14 will then be folded upwardly perpendicular to bottom panel 12, as shown sequentially in FIGS. 3-5. Top panel 18 is then folded down, toward and parallel to bottom panel 12; and outer end panels 34, 36 are folded over inner end panels 22, 24, respectively and adhered to end panels 22, 24. Finally, reinforcing flanges (minor flaps) 38, 40, 42, 44 are folded perpendicular to outer end panels 34, 36, and adhesively adhered to the outer surfaces of front and rear (side) panels 14, 16. When top panel 18 is folded down, closure flap 20 is preferably folded to the outside of front panel 14, and adhesively affixed to the outer surface thereof (FIG. 6).

Figure 14:
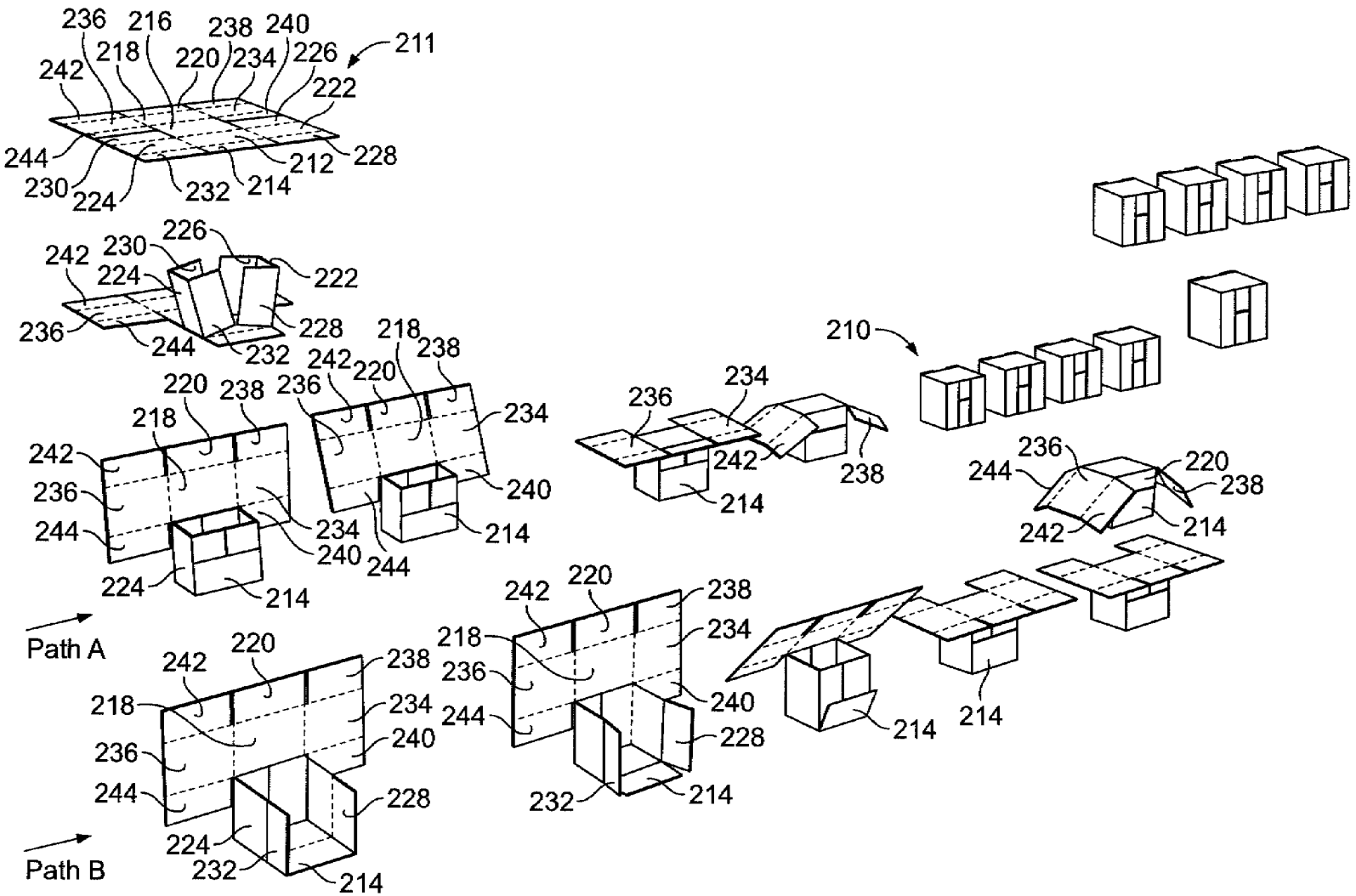
FIG. 14 is a perspective view of a container according to another embodiment of the invention, showing two different articulation "paths" for two different possible container loading "paths".

In an alternative sequence, which is described in detail with respect to the embodiment of FIG. 14, but which is understood to be applicable to all of the embodiments described and/or illustrated herein, the goods to be packaged are not placed on the bottom panel prior to any articulation. Instead, the front inner minor flaps and the front panel may not be folded with respect to the inner end panels and the bottom panel, respectively, at the same time that the rear inner minor flaps and the rear panel are folded and adhered with respect to the inner end panels and the bottom panel, respectively. This would result in a partially erected container, having an open frontal area, into which the goods to be packaged would be thrust, relying upon the inner surfaces of the rear inner minor flaps to provide stacking or other alignment structures. Upon insertion of the goods, the remaining panels and flaps are articulated and glued substantially as previously described.

The first variation of the general design of FIGS. 1-9 may be addressed in an alternative manner. The width of the carton is still considerably greater than the depth or height. The minor flaps are all each substantially less than one-half the width of the carton, so that there is a substantial gap between facing free edges of the minor flaps on the interior and exterior faces of the front and rear walls, thus creating "corner post" reinforcement structures, rather than complete end or side walls. The closure tab emanates from the free edge of the top panel, and is folded to be juxtaposed and adhesively affixed to the front panel.

Container 10 will be formed from blank 11 (FIG. 2) Blank 11 includes bottom panel 12, front (side) panel 14, rear (side) panel 16, top panel 18 and closure flap 20; as well as fold lines 13, 15, 17 and 19. Blank 11 also includes inner end panels 22, 24 (emanating along fold lines 21, 23, respectively) from which interior minor flaps 26, 28, 30, 32 emanate along fold lines 25, 27, 29 and 31, respectively. Outer end panels 34, 36 emanate from top panel 18 along fold lines 33, 35, respectively. Reinforcing flanges 38, 40, 42, 44 emanate from outer end panels 34, 36, along fold lines 37, 39, 41 and 43, respectively. The end edges of panels 14 and 16 may be vertical. Alternatively, the end edges of rear panel 16 preferably may be concavely bowed and the end edges of front panel 14 preferably may be inwardly inclined from bottom to top (both as illustrated), because this style of slot configuration may permit ease of removing and ease of stripping the waste material from the designated and created aperture in the blank sheet. As an alternative, rather than the described designated slot, a singular cut including offsets as required may be implemented thereby eliminating a need to remove waste material.

In a typical alternative articulation procedure, first the blank 11 is formed into a tray-like container as per FIG. 10 whereby inner minor panels 26, 28, 30 and 32 are folded along folds 25, 27, 29 and 31, respectively, perpendicular to inner end panels 22 and 24. End panels 22 and 24 are then folded along folds 21 and 23, respectively, perpendicular to bottom panel 12. Inner minor panels 26, 28, 30 and 32 are adhesively adhered to front (side) panel 14 and rear (side) panel 16. Product to be contained will be drop packed into the formed cavity whose perimeter can consist of inner minor flaps 26, 28, 30 and 32, front (side) panel 14 and rear (side) panel 16, inner end panels 22 and 24 along with bottom panel 12 of blank 11 and as shown sequentially in FIGS. 3-5. Top panel 18 is then folded down, toward and parallel to bottom panel 12; and outer end panels 34, 36 are folded over inner end panels 22, 24, respectively and adhered to end panels 22, 24. Finally, reinforcing flanges (minor flaps) 38, 40, 42 and 44 are folded perpendicular to outer end panels 34, 36 and adhesively adhered to the outer surfaces of front and rear (side) panels 14, 16. When top panel 18 is folded down, closure flap 20 is preferably folded to the outside of front panel 14, and adhesively affixed to the outer surface thereof (FIG. 6).

In an alternative sequence, which is described in detail with respect to the embodiment of FIG. 14, but which is understood to be applicable to all of the embodiments described and/or illustrated herein, the goods to be packaged are not placed on the bottom panel prior to any articulation. The product will be drop packed into the described walled cavity whose perimeter is formed from inner minor flaps 226, 228, 230 and 232 along with inner end panels 222 and 224 and bottom panel 212. Depending upon proportions, the rear perimeter will be formed by the addition of rear (side) panel 216. The front (side) panel of the tray may only be a portion of the front perimeter panel and would be completed by the top panel 220. The front inner minor flaps and the partial front panel may be folded with respect to the inner end panels and the bottom panel, respectively, at the same time that the rear inner minor flaps and the rear panel are folded and adhered with respect to the inner end panels and the bottom panel, respectively. This would result in an erected tray container, having a partially open frontal area, into which the goods to be packaged would be drop packed, relying upon the inner surfaces of the rear inner minor flaps, the inner end panels, the front minor flaps, and potentially, a partial front (side) panel as well as a rear (side) panel to provide stacking or other alignment structures. Upon insertion of the goods, the remaining panels and flaps are articulated and glued substantially as previously described.

A second variation of the design (FIGS. 10A-10D and 11) is substantially the same as that of FIGS. 1-9, except that the closure tab 20' is trapezoidal. Accordingly, the blank forming container 10' is substantially identical to blank 11 forming container 10 of FIGS. 1-9, and the method of articulation of the blank forming container 10' is substantially identical to the method of articulation of blank 11.

Therefore, the panels and fold lines forming blank 11' which are similar or identical to corresponding panels and fold lines of blank 11 are provided with like reference numerals, augmented by a prime ('). The process of articulation of blank 11' is illustrated in FIGS. 10A-10D.

Figure 11:
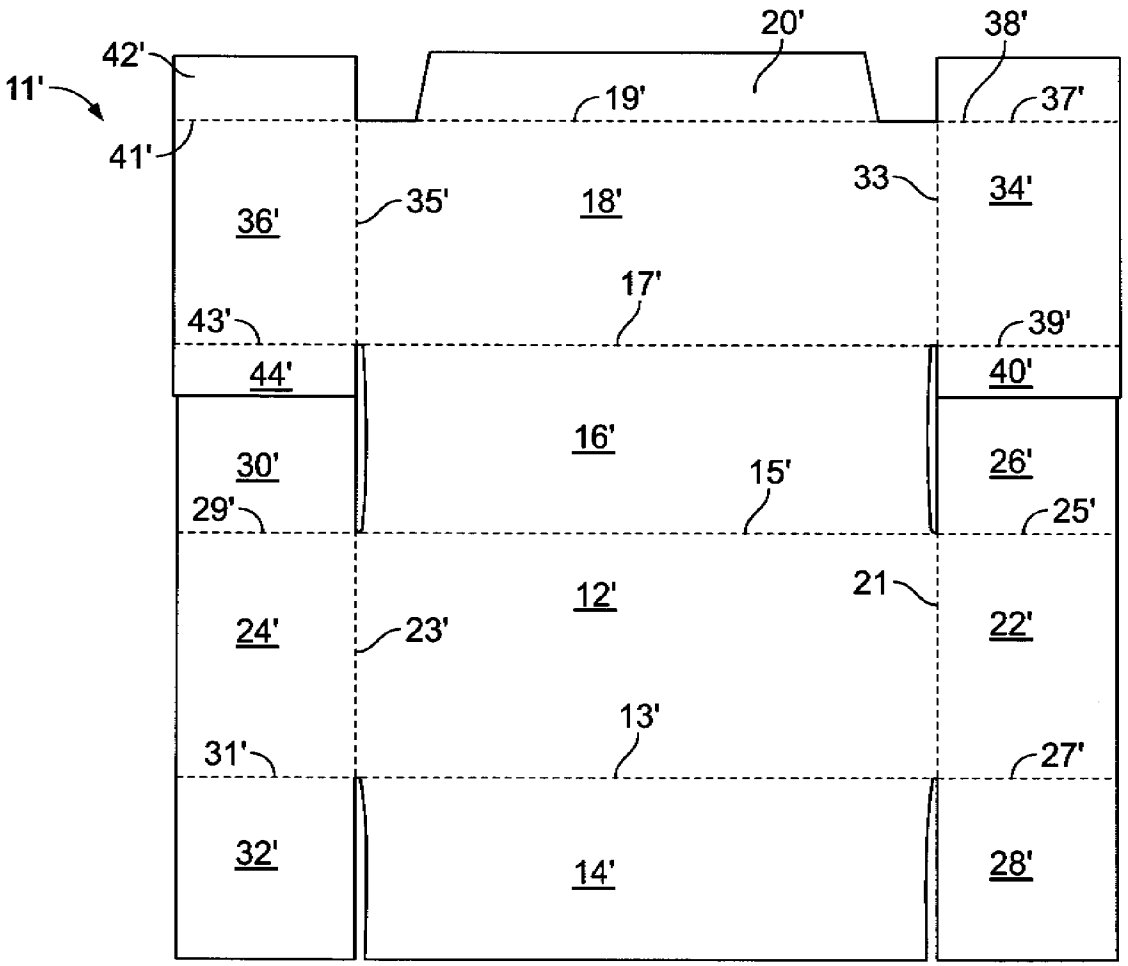
FIG. 11 is a plan view of a blank for the container of FIGS. 10A-10D.

Container 10' is formed from blank 11' (FIG. 11). Blank 11' includes bottom panel 12', front (side) panel 14', rear (side) panel 16', top panel 18' and closure flap 20'; as well as fold lines 13', 15', 17' and 19'. Blank 11' also includes inner end panels 22', 24' (emanating along fold lines 21', 23', respectively) from which interior minor flaps 26', 28', 30', 32' emanate along fold lines 25', 27', 29' and 31', respectively. Outer end panels 34', 36' emanate from top panel 18' along fold lines 33', 35', respectively. Reinforcing flanges 38', 40', 42', 44' emanate from outer end panels 34', 36', along fold lines 37', 39', 41' and 43', respectively. The end edges of panel 14' and 16' may be vertical. Alternatively, the end edges of both rear panel 16' and front panel 14' preferably may be concavely bowed or notched (as illustrated), because this style of slot configuration may permit ease of removing and ease of stripping the waste material from the designated and created aperture in the blank sheet. As an alternative, rather than the designated and created slot, a singular cut including offsets as required may be implemented thereby eliminating a need to remove waste material.

Figure 10C:
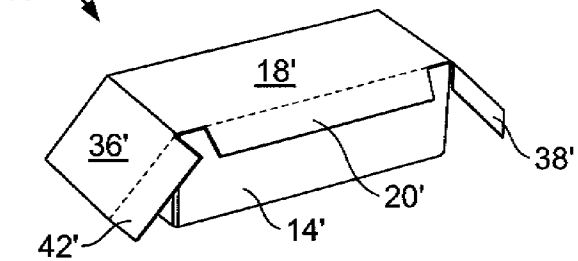
FIG. 10C is a perspective view of the container according to FIG. 10A, shown in a further stage of articulation.
Figure 10D:
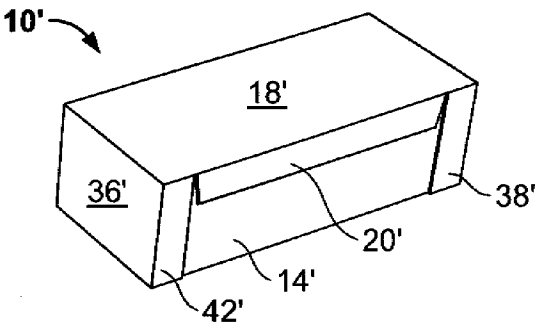
FIG. 10D is a perspective view of the container of FIG. 10A, shown fully articulated.
Figure 10B:
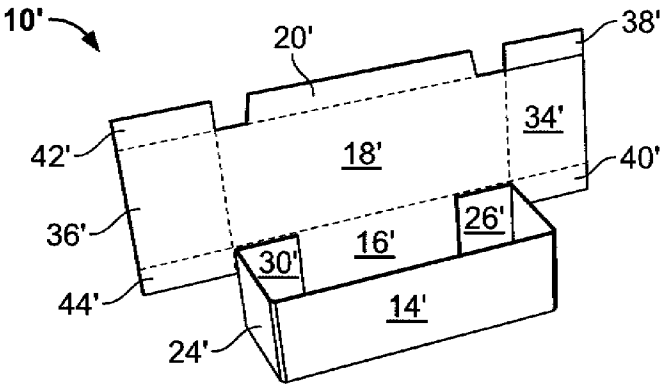
FIG. 10B is a perspective view of the container according to FIG. 10A, shown in a further stage of articulation.
Figure 10A:
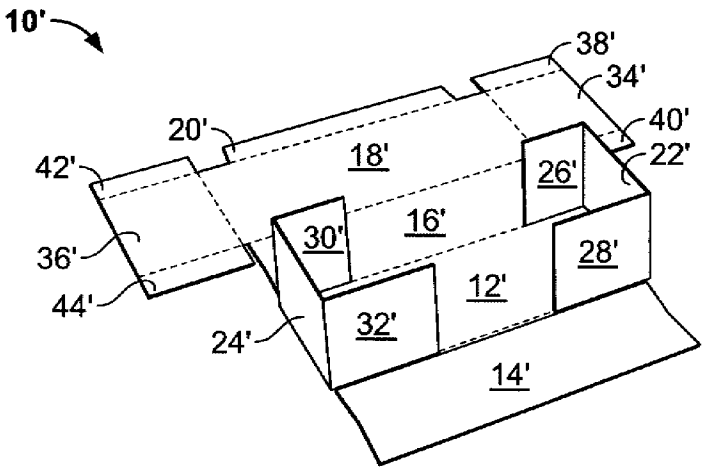
FIG. 10A is a perspective view of a container according to another embodiment of the invention, shown partially articulated.

In a typical articulation procedure, first, the product to be contained will be pushed onto blank 11', which will be laid flat on a packaging apparatus. Flaps 30', 32' will be folded perpendicular to panel 24', and flaps 26', 28' will be folded perpendicular to panel 22'. Panels 22', 24' will be folded upwardly perpendicularly to bottom panel 12'. Rear (side) panel 16' and front (side) panel 14' will then be folded upwardly perpendicular to bottom panel 12', as shown sequentially in FIGS. 10A-10D. Top panel 18' is then folded down, toward and parallel to bottom panel 12'; and outer end panels 34', 36' are folded over and adhered to inner end panels 22', 24', respectively. Finally, reinforcing flanges (minor flaps) 38', 40', 42' and 44' are folded perpendicular along folds 37', 39', 41' and 42', respectively to outer end panels 34', 36', and adhesively adhered to the outer surfaces of front and rear (side) panels 14', 16'. When top panel 18' is folded down, closure flap 20' is preferably folded to the outside of front panel 14', and adhesively affixed to the outer surface thereof (FIGS. 10C and 10D).

A third variation of the design (FIGS. 12 and 13) is similar to the variations of FIGS. 1-9 and 10-11, except that the closure tab emanates from the free edge of the front panel 114, and is trapezoidal.

Figure 12:
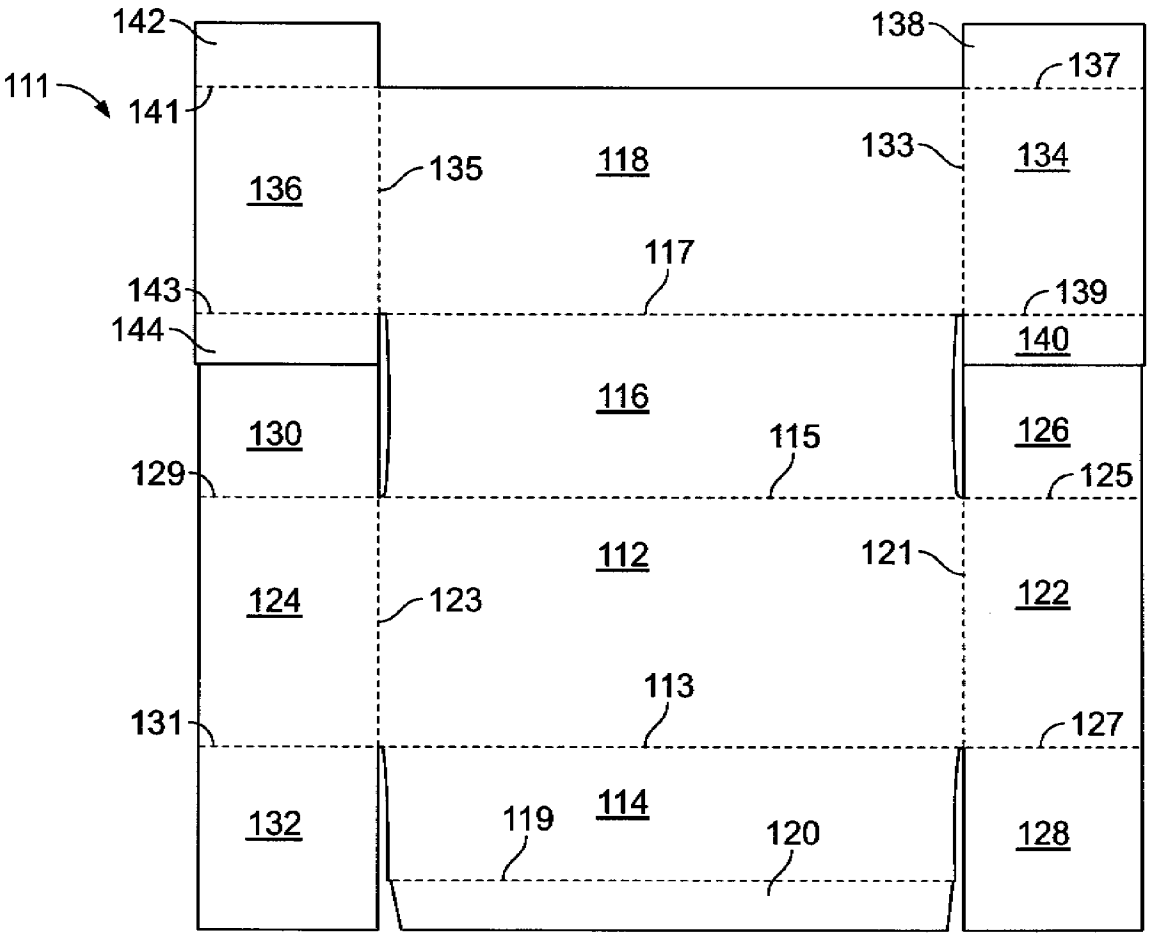
FIG. 12 is a plan view of a blank for a container according to another embodiment of the invention.
Figure 13C:
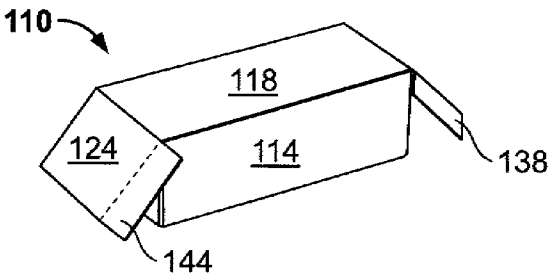
FIG. 13C is a perspective view of the container according to FIG. 13A, shown in a further stage of articulation.
Figure 13D:
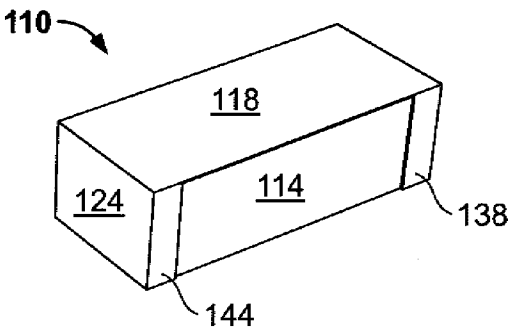
FIG. 13D is a perspective view of the container of FIG. 13A, shown fully articulated.
Figure 13B:
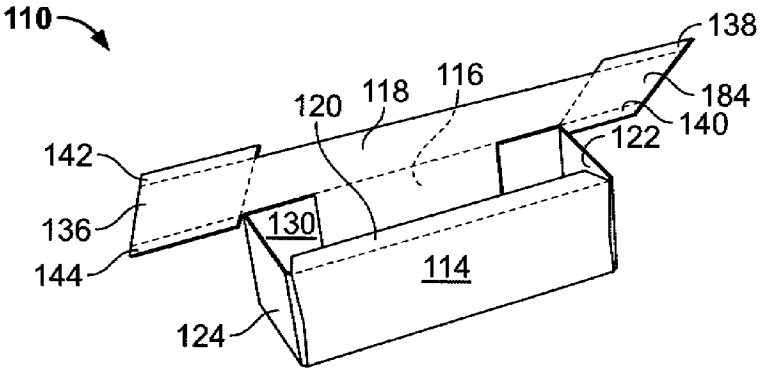
FIG. 13B is a perspective view of the container according to FIG. 13A, shown in a further stage of articulation.
Figure 13A:
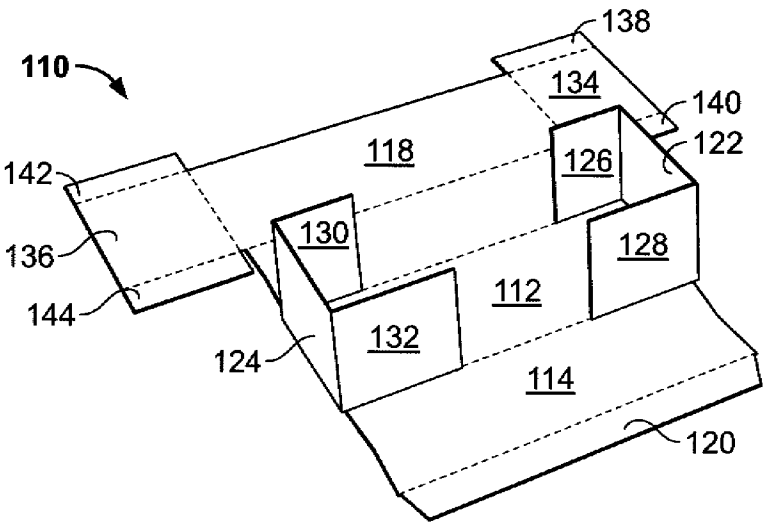
FIG. 13A is a perspective view of a container according to the embodiment of FIG. 12, shown partially articulated.

Container 110 is formed from blank 111 (FIG. 12). Blank 111 includes bottom panel 112, front (side) panel 114, rear (side) panel 116, top panel 118 and closure flap 120; as well as fold lines 113, 115, 117 and 119. Blank 111 also includes inner end panels 122, 124 (emanating along fold lines 121, 123, respectively) from which interior minor flaps 126, 128, 130, 132 emanate along fold lines 125, 127, 129 and 131, respectively. Outer end panels 134, 136 emanate from top panel 118 along fold lines 133, 135, respectively. Reinforcing flanges 138, 140, 142, 144 emanate from outer end panels 134, 136, along fold lines 137, 139, 141 and 143, respectively. The end edges of panels 114 and 116 may be vertical. Alternatively, the end edges of both rear panel 116 and front panel 114 preferably may be concavely bowed or notched (as illustrated), because this style of slot configuration may permit ease of removing and ease of stripping the waste material from the designated and created aperture in the blank sheet. As an alternative, rather than the described designated slot, a singular cut including offsets as required may be implemented, thereby eliminating a need to remove waste material.

In a typical articulation procedure, first, the product to be contained will be pushed onto blank 111, which will be laid flat on a packaging apparatus.

Flaps 130, 132 will be folded perpendicular to panel 124, and flaps 126, 128 will be folded perpendicular to panel 122. Panels 122, 124 will be folded upwardly perpendicularly to bottom panel 112. Rear (side) panel 116 and front (side) panel 114 will then be folded upwardly perpendicular to bottom panel 112, as shown in FIGS. 13A-13D. Top panel 118 is then folded down, toward and parallel to bottom panel 112; and outer end panels 134, 136 are folded over and adhesively affixed to inner end panels 122, 124, respectively. Finally, reinforcing flanges (minor flaps) 138, 140, 142 and 144 are folded perpendicular to outer end panels 134, 136, and adhesively adhered to the outer surfaces of front and rear (side) panels 114, 116. When top panel 118 is folded down, closure flap 120 is preferably folded to the inside of top panel 118, and adhesively affixed to the inside surface thereof.

In a fourth variation of the design (FIG. 14), which is generally similar to the embodiment of FIGS. 1-9, the ratio of the width of the carton to the depth of the carton is still greater than one, but substantially less than in the variations of FIGS. 1-9; 10-11; or 12-13. As such, the widths of the "minor" flaps equals one-half the width of the carton, so that the minor-flap-facing free edges meet or nearly meet, along the side-to-side midpoint of the carton, along the inside and outside surfaces of the front and rear panels.

Container 210 is formed from blank 211 (FIG. 14). Blank 211 includes bottom panel 212, front (side) panel 214, rear (side) panel 216, top panel 218 and closure flap 220; as well as fold lines positioned similarly to fold lines 13, 15, 17 and 19 of FIG. 2. Blank 211 also includes inner end panels 222, 224 (emanating along fold lines positioned similarly to fold lines 21, 23, of FIG. 2, respectively) from which interior minor flaps 226, 228, 230, 232 emanate along fold lines positioned similarly to fold lines 25, 27, 29 and 31 of FIG. 2, respectively. Outer end panels 234, 236 emanate from top panel 218 along fold lines positioned similarly to fold lines 33, 35 of FIG. 2. Reinforcing flanges 238, 240, 242, 244 emanate from outer end panels 234, 236, along fold lines positioned similarly to fold lines 37, 39, 41 and 43 of FIG. 2, respectively. The end edges of rear panel 216 and front panel 214 may be concavely bowed or notched, or inwardly inclined from bottom to top, or vertical, as disclosed in previously described embodiments, if so desired or deemed necessary in accordance with the requirements of any particular application.

In a typical articulation procedure, first, the product to be contained will be pushed onto blank 211, which will be laid flat on a packaging apparatus. Flaps 230, 232 will be folded perpendicular to panel 224, and flaps 226, 228 will be folded perpendicular to panel 222. Panels 222, 224 will be folded upwardly perpendicularly to bottom panel 212. Rear (side) panel 216 and front (side) panel 214 will then be folded upwardly perpendicular to bottom panel 212, as shown in Path A of FIG. 14. Top panel 218 is then folded down, toward and parallel to bottom panel 212; and outer end panels 234, 236 are folded over and adhesively affixed to inner end panels 222, 224, respectively. Finally, reinforcing flanges (minor flaps) 238, 240, 242, 244 are folded along folds 237, 239, 241 and 243, respectively, perpendicular to outer end panels 234, 236, and adhesively adhered to the outer surfaces of front and rear (side) panels 214, 216 and 220. When top panel 218 is folded down, closure flap 220 is preferably folded to the outside of front minor flaps 228 and 234, and adhesively affixed to the outer surface thereof, but to the inside of reinforcing flanges 242, 238, due to the breadth of those flanges.

In an alternative embodiment of the method for forming the package, shown in Path B, front panel 214 is not raised at the same time as rear panel 216, and minor flaps 232 and 228 are likewise not folded inwardly, at the same time as flaps 230, 226. This provides for a "tray-like" function, in that instead of placing the product on bottom panel 212, prior to any articulation, positioning of the product may be delayed until the configuration that is the first step (as reflected by the arrow) in Path B is attained. In this configuration, because there is a "back wall" formed by minor flaps 230, 226, the container can serve as a straightening or alignment structure, for more or less loosely collected, stacked or otherwise aligned, products.

Regardless of the path taken, the structure and configuration of the container according to FIG. 14 will be the same, as shown in the right-hand side of that figure.

A fifth variation of the design (FIG. 15) is similar to the design of FIGS. 1-9, except that, upon articulation, the sides of the carton are all inclined, so that the resultant container is frusto-pyramidal in configuration.

Figure 15:
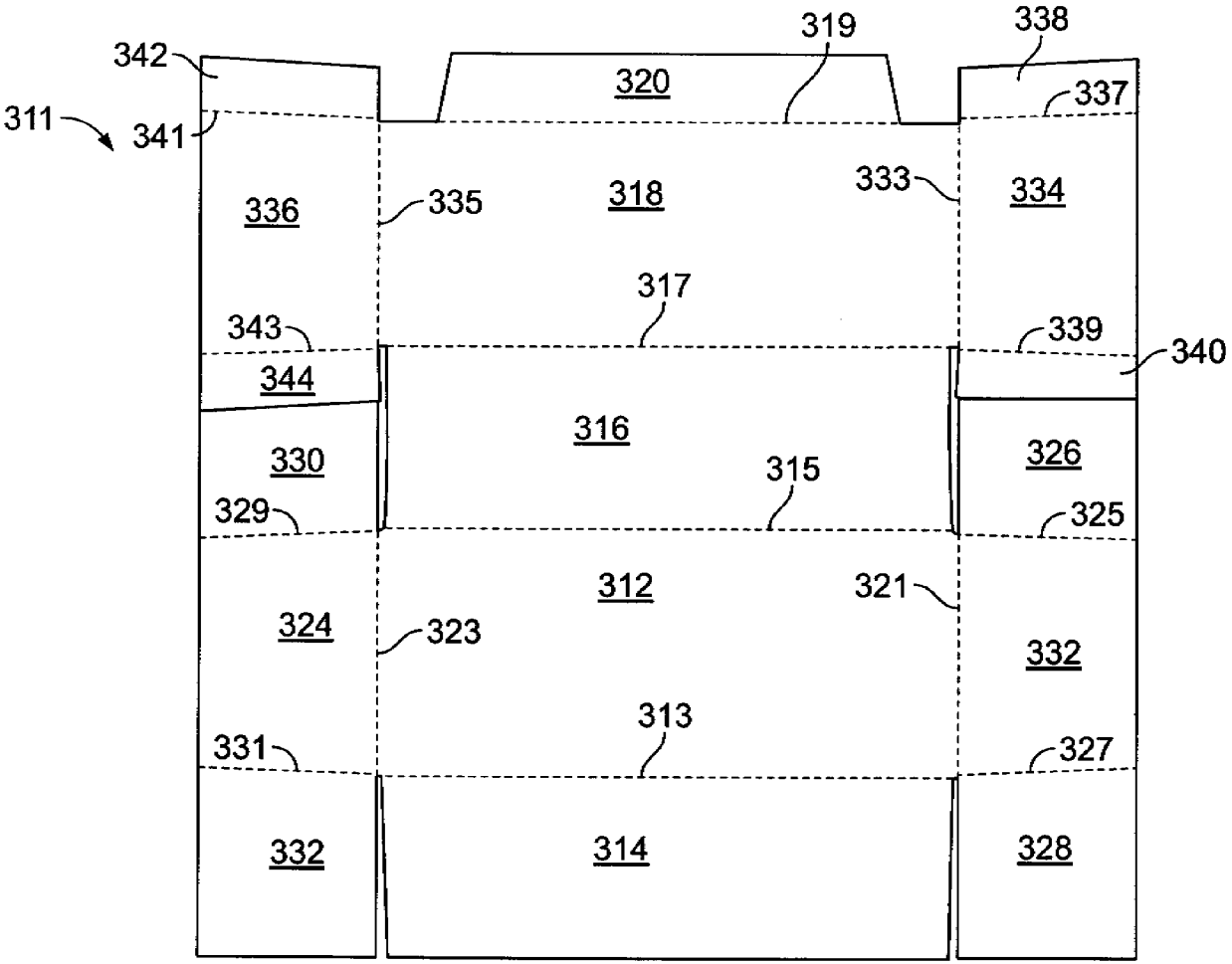
FIG. 15 is a plan view of a container according to another embodiment of the invention, similar to the container of FIGS. 1-9, but resulting in a container having a frusto-pyramidal configuration.

The frusto-pyramidal container is formed from blank 311 (FIG. 15). Blank 311 includes bottom panel 312, front (side) panel 314, rear (side) panel 316, top panel 318 and closure flap 320; as well as fold lines 313, 315, 317 and 319. Blank 311 also includes inner end panels 322, 324 (emanating along fold lines 321, 323, respectively) from which interior minor flaps 326, 328, 330, 332 emanate along fold lines 325, 327, 329 and 331, respectively. Outer end panels 334, 336 emanate from top panel 318 along fold lines 333, 335, respectively. Reinforcing flanges 338, 340, 342, 344 emanate from outer end panels 334, 336, along fold lines 337, 339, 341 and 343, respectively. The end edges of rear panel 316 may be concavely bowed (as illustrated), notched, inclined or vertical, while the end edges of front panel 314 may be vertical (as illustrated), inwardly inclined from bottom to top, or concave, because this style of slot configuration may permit ease of removing and ease of stripping the waste material from the designated and created aperture in the blank sheet. As an alternative, rather than the described designated slot, a singular cut including offsets as required may be implemented thereby eliminating a need to remove waste material.

In a typical articulation procedure, first, the product to be contained will be pushed onto blank 311, which will be laid flat on a packaging apparatus. Flaps 330, 332 will be folded perpendicular to panel 324, and flaps 326, 328 will be folded perpendicular to panel 322. Panels 322, 324 will be folded upwardly perpendicularly to bottom panel 312. Rear (side) panel 316 and front (side) panel 314 will then be folded upwardly perpendicular to bottom panel 312. Top panel 318 is then folded down, toward and parallel to bottom panel 312; and outer end panels 334, 336 are folded over inner end panels 322, 324, respectively. Finally, reinforcing flanges (minor flaps) 338, 340, 342 and 344 are folded along folds 337, 339, 341 and 343 perpendicular to outer end panels 334, 336, and adhesively adhered to front and rear (side) panels 314, 316. When top panel 318 is folded down, closure flap 320 is preferably folded to the outside of front panel 314, and adhesively affixed to the outer surface thereof.

Fold lines 329, 331, 325, and 327 are all at non-perpendicular angles with respect to fold lines 323, 321, respectively. Similarly, fold lines 341, 343, 337 and 339 are all at non-perpendicular angles with respect to fold lines 335 and 333, respectively. In addition, panels 342, 344, 330, 332, 338, 340, 326, 328 are all non-rectangular. Further, bottom panel 312 is deeper, from front to back, than top panel 318. Thus, upon articulation, the resultant container has inwardly inclined front, rear, and end regions, to create a frusto-pyramidal container.

A sixth variation of the design (FIG. 16) is similar to the design of FIGS. 12-13, except that, upon articulation, the sides of the carton are all inclined, so that the resultant carton is frusto-pyramidal in configuration.

Figure 16:
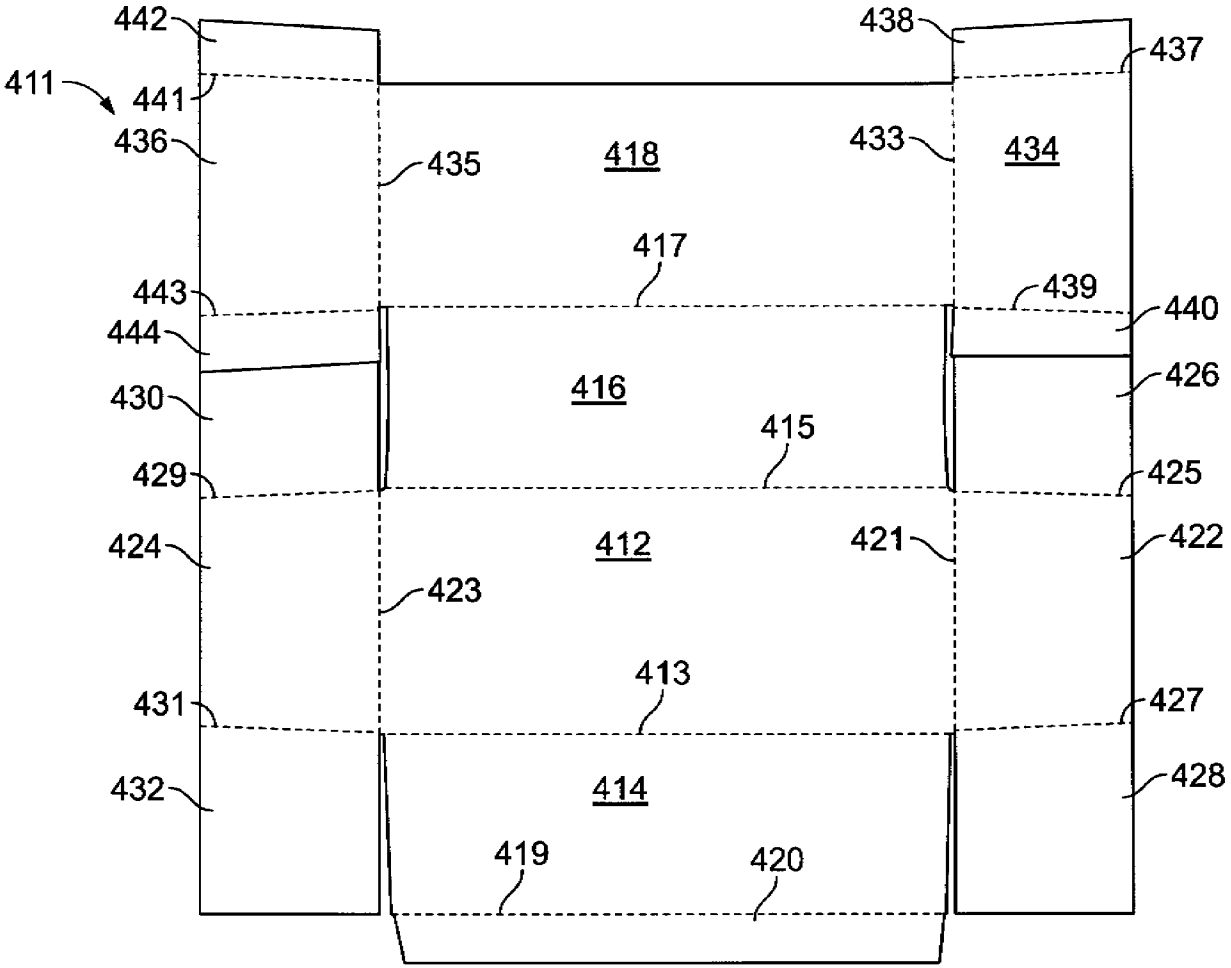
FIG. 16 is a plan view of a container according to another embodiment of the invention, similar to the container of FIGS. 13A-13D and 14.
Figure 17A:
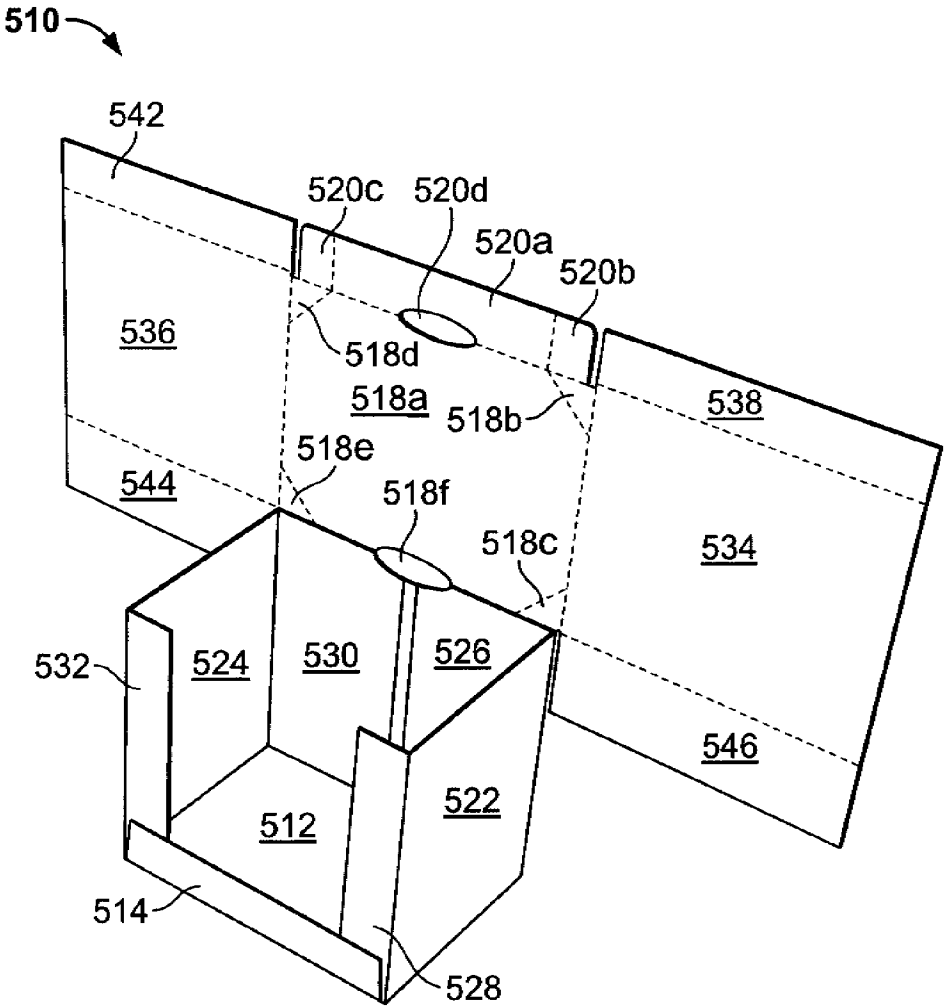
FIG. 17A is a perspective view of a container according to another embodiment of the invention, with the container substantially fully articulated except for final closure, wherein the container further includes removable portions for display conversion.
Figure 17B:
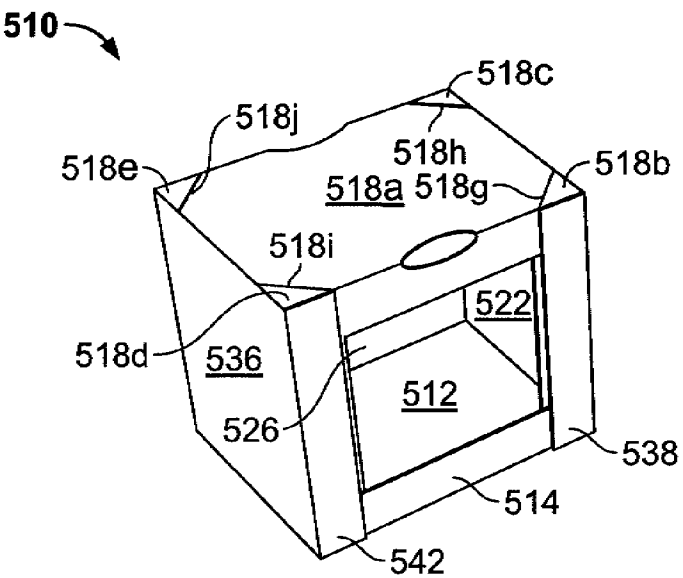
FIG. 17B is a perspective view of a container according to the embodiment of FIG. 17A, in its fully articulated configuration.
Figure 18B:
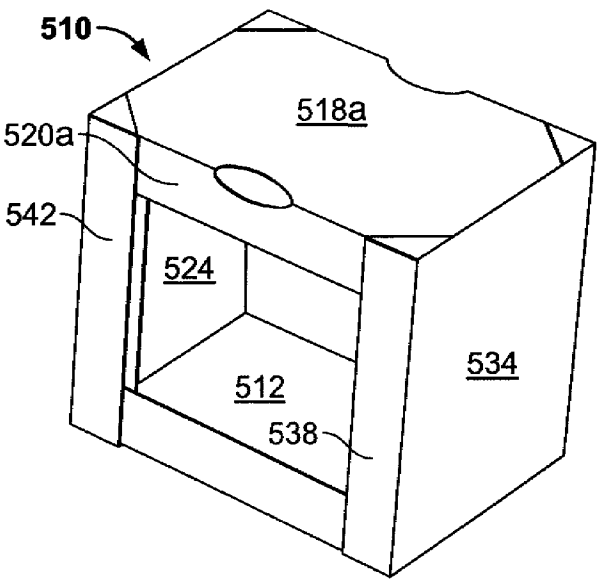
FIG. 18B is a perspective view of the container of FIGS. 17A-18A.
Figure 18A:
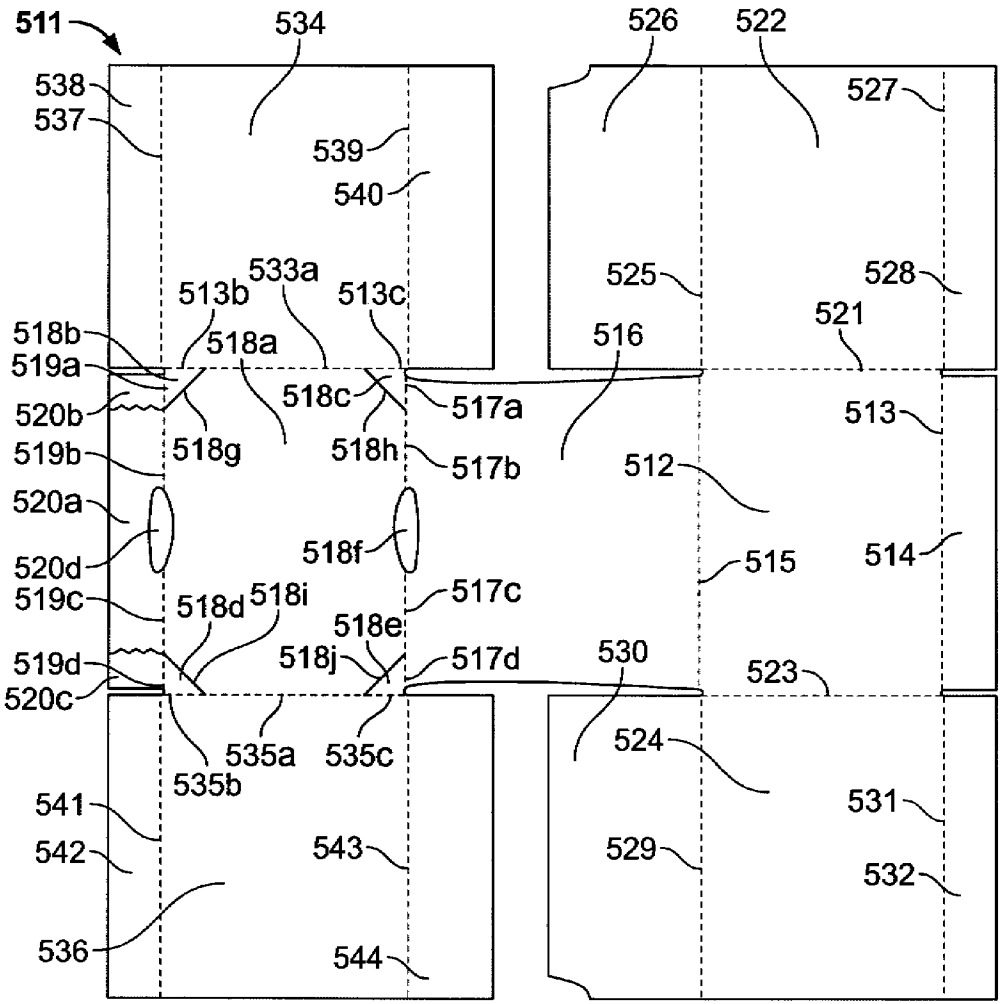
FIG. 18A is a plan view of the blank for the container of FIGS. 17A and 17B.
Figures 19A, 19B, 19C, 19D, 19E, 19F:
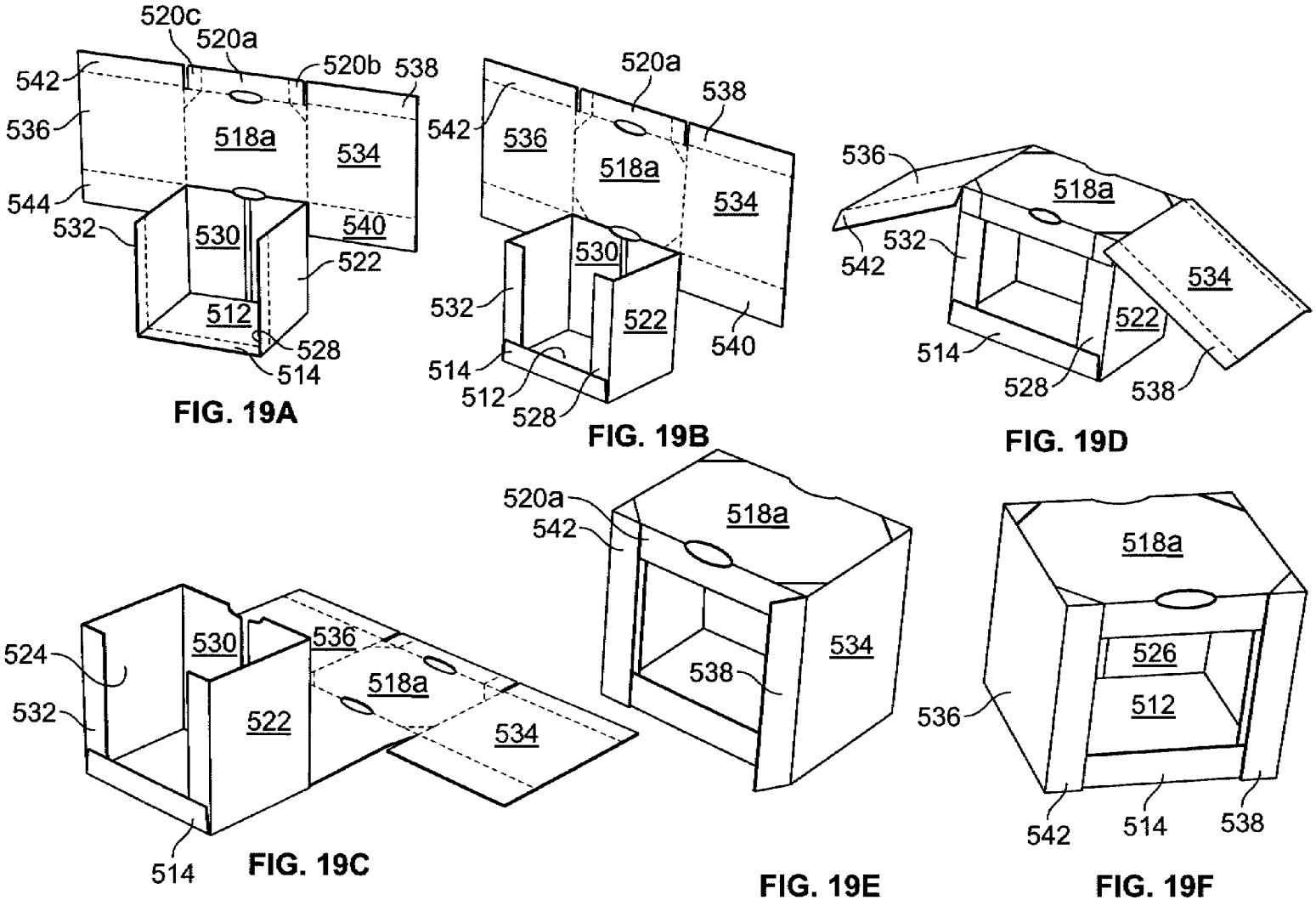
FIG. 19A is a perspective view of the container of FIG. 17A, shown partially articulated.
FIG. 19B is a perspective view of the container of FIG. 19A, shown further along in the articulation process.
FIG. 19C is a perspective view of the container of FIG. 17A, shown partially articulated, via a different sequence of articulation steps.
FIG. 19D is a perspective view of the container of FIG. 19C, shown further along the articulation process.
FIG. 19E is a perspective view of the container of FIG. 19D, shown further along the articulation process.
FIG. 19F is a perspective view of the container of FIG. 19E, shown fully articulated.

The container is formed from blank 411 (FIG. 16). Blank 411 includes bottom panel 412, front (side) panel 414, rear (side) panel 416, top panel 418 and closure flap 420; as well as fold lines 413, 415, 417 and 419. Blank 411 also includes inner end panels 422, 424 (emanating along fold lines 421, 423, respectively) from which interior minor flaps 426, 428, 430, 432 emanate along fold lines 425, 427, 429 and 431, respectively. Outer end panels 434, 436 emanate from top panel 418 along fold lines 433, 435, respectively. Reinforcing flanges 438, 440, 442, 444 emanate from outer end panels 434, 436, along fold lines 437, 439, 441 and 443, respectively. The end edges of panels 414 and 416 may be vertical. Alternatively, the end edges of both rear panel 416 and front panel 414 preferably may be concavely bowed or notched (as illustrated), because this style of slot configuration may permit ease of removing and ease of stripping the waste material from the designated and created aperture in the blank sheet. As an alternative, rather than the described designated slot, a singular cut including offsets as required may be implemented thereby eliminating a need to remove waste material.

In a typical articulation procedure, first, the product to be contained will be pushed onto blank 411, which will be laid flat on a packaging apparatus. Flaps 430, 432 will be folded perpendicular to panel 424, and flaps 426, 428 will be folded perpendicular to panel 422. Panels 422, 424 will be folded upwardly perpendicularly to bottom panel 412. Rear (side) panel 416 and front (side) panel 414 will then be folded upwardly perpendicular to bottom panel 412. Top panel 418 is then folded down, toward and parallel to bottom panel 412; and outer end panels 434, 436 are folded over inner end panels 422, 424, respectively. Finally, reinforcing flanges (minor flaps) 438, 440, 442 and 444 are folded perpendicular to outer end panels 434, 436, and adhesively adhered to the outer surfaces of front and rear (side) panels 414, 416. When top panel 418 is folded down, closure flap 420 is preferably folded to the inside of top panel 418, and adhesively affixed to the inside surface thereof.

Fold lines 429, 431, 425, and 427 are all at non-perpendicular angles with respect to fold lines 423, 421, respectively. Similarly, fold lines 441, 443, 437 and 439 are all at non-perpendicular angles with respect to fold lines 435 and 433, respectively. In addition, panels 442, 444, 430, 432, 438, 440, 426, 428 are all non-rectangular. Further, bottom panel 412 is deeper, from front to back, than top panel 418. Thus, upon articulation, the resultant container has inwardly inclined front, rear, and end regions, to create a frusto-pyramidal container.

The seventh variation (FIGS. 17A-19F) of the design are similar to the basic design of FIGS. 1-9; except that the front panel is substantially shorter than the rear panel, to create an open display region, and lines of weakness are provided in the closure tab, along the middle portions of the front, rear, and side edges of the top panel and along diagonals at the corners of the top panel. This permits the bulk of the top panel to be removed, leaving triangular-shaped top panel sections remaining, for strength, stability and stacking ability.

Container 510 is formed from blank 511. Blank 511 includes bottom panel 512, front (side) panel 514, rear (side) panel 516, top center panel 518*a* with top corner panels 518*b*-518*d*, and closure flap 520; as well as fold lines 513, 515, 517*a* and 517*d* and 519*a* and 519*d*. Blank 511 also includes inner end panels 522, 524 (emanating along fold lines 521, 523, respectively) from which interior minor flaps 526, 528, 530, 532 emanate along fold lines 525, 527, 529 and 531, respectively. Outer end panels 534, 536 emanate from top center panel 518*a* and its respective corner panels, along fold lines 533*b*-*c*, 535*b*-*c*, and perforations 533*a*, 535*a*, respectively. Reinforcing flanges 538, 540, 542, 544 emanate from outer end panels 534, 536, along fold lines 537, 539, 541 and 543, respectively. Blank 511 also includes perforation lines 517*b*, 517*c*, 518*g*-*j*, 519*b* and 519*c*, as well as apertures 518*f* and 520*d*.

The end edges of panels 514 and 516 may be vertical. Alternatively, the end edges of rear panel 516 preferably may be concavely bowed and the end edges of front panel 514 preferably may be inwardly inclined from bottom to top (both as illustrated), because this style of slot configuration may permit ease of removing and ease of stripping the waste material from the designated and created aperture in the blank sheet. As an alternative, rather than the described designated slot, a singular cut including offsets as required may be implemented thereby eliminating a need to remove waste material.

In a typical articulation procedure, first, the product to be contained will be pushed onto blank 511, which will be laid flat on a packaging apparatus. Flaps 530, 532 will be folded perpendicular to panel 524, and flaps 526, 528 will be folded perpendicular to panel 522. Panels 522, 524 will be folded upwardly perpendicularly to bottom panel 512. Rear (side) panel 516 and front (side) panel 514 will then be folded upwardly perpendicular to bottom panel 512, as shown sequentially in FIGS. 17A and 19A-19F. Top panel 518 is then folded down, toward and parallel to bottom panel 512; and outer end panels 534, 536 are folded over and adhesively adhered to the outer surfaces of inner end panels 522, 524, respectively. Finally, reinforcing flanges (minor flaps) 538, 540, 542 and 544 are folded perpendicular to outer end panels 534, 536, and adhesively adhered to the outer surface of rear (side) panel 516, outer surface of front (side) panel 514 and outer surfaces of closure flap 520, specifically outer surfaces of top closure front panels 520*c* and 520*b*. When top panel 518 is folded down, closure flap 520 is preferably folded to the outside surfaces of interior minor flaps 532 and 528 and adhesively affixed to the outer surface thereof.

Instead of ripping or cutting the container apart, as in other wraparound container constructions, access to the interior of container 510 is achieved, via removal of top center panel 518*a*, tearing along perforation lines 533*a*, 518*h*, 517*b*, 517*c*, 518*j*, 535*a*, 518*i*, 519*c*, 519*b* and 518*g*, leaving behind a display tray having four corner posts, with triangular top corner panels for still enabling stacking of the opened tray. FIGS. 19A-19F show different ways in which articulation of blank 511 may be accomplished, to arrive at the fully articulated configuration of FIG. 19F.

In the eighth variation of the design (FIGS. 20-24), there is no closure tab along either of the leading or trailing edges of the blank. Instead, there are trapezoidal areas of both the top and front panels that are die cut out, to leave an open area along the top and front panels, for display and dispensing purposes, without removal of material from the carton.

Figure 20:
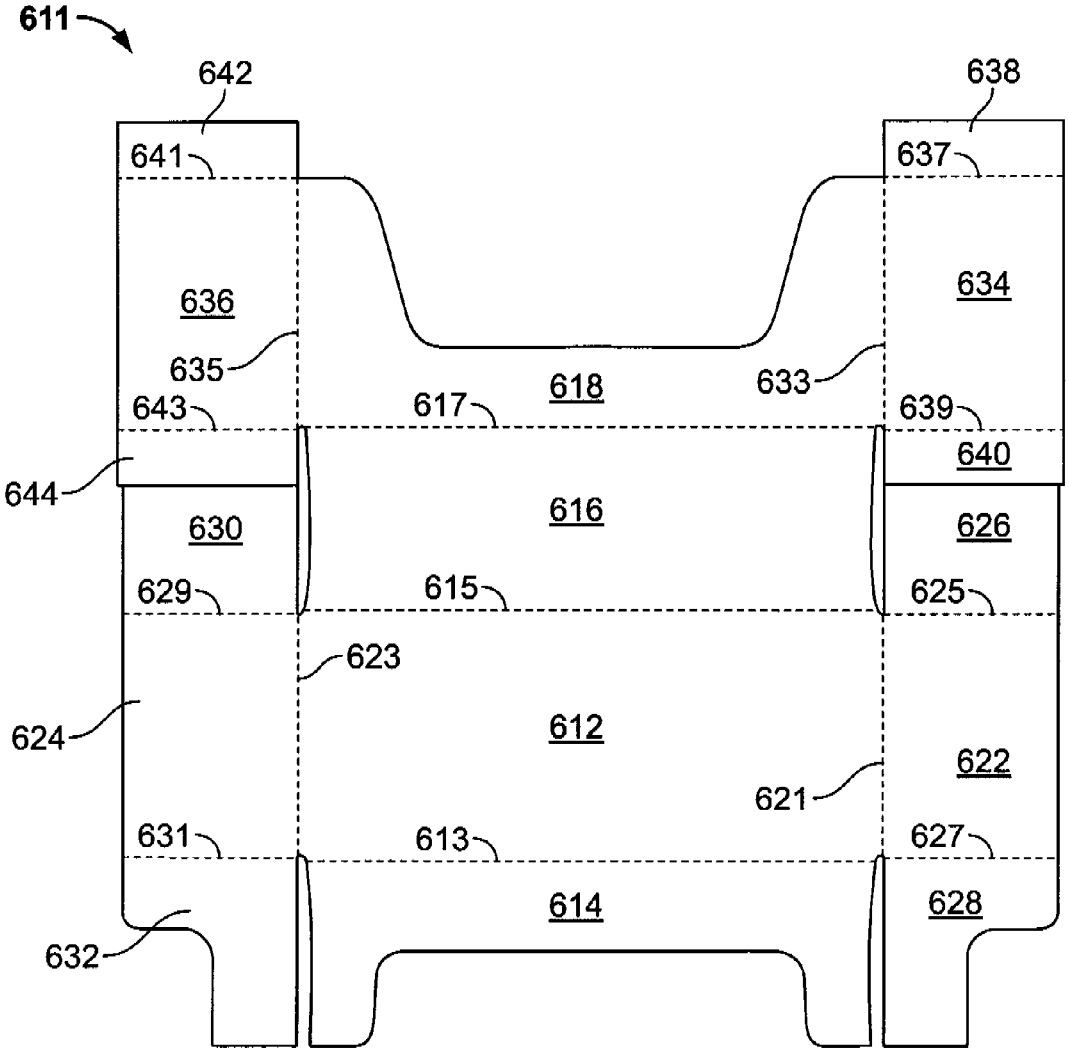
FIG. 20 is a plan view of a blank for a container according to another embodiment of the present invention.
Figure 21B:
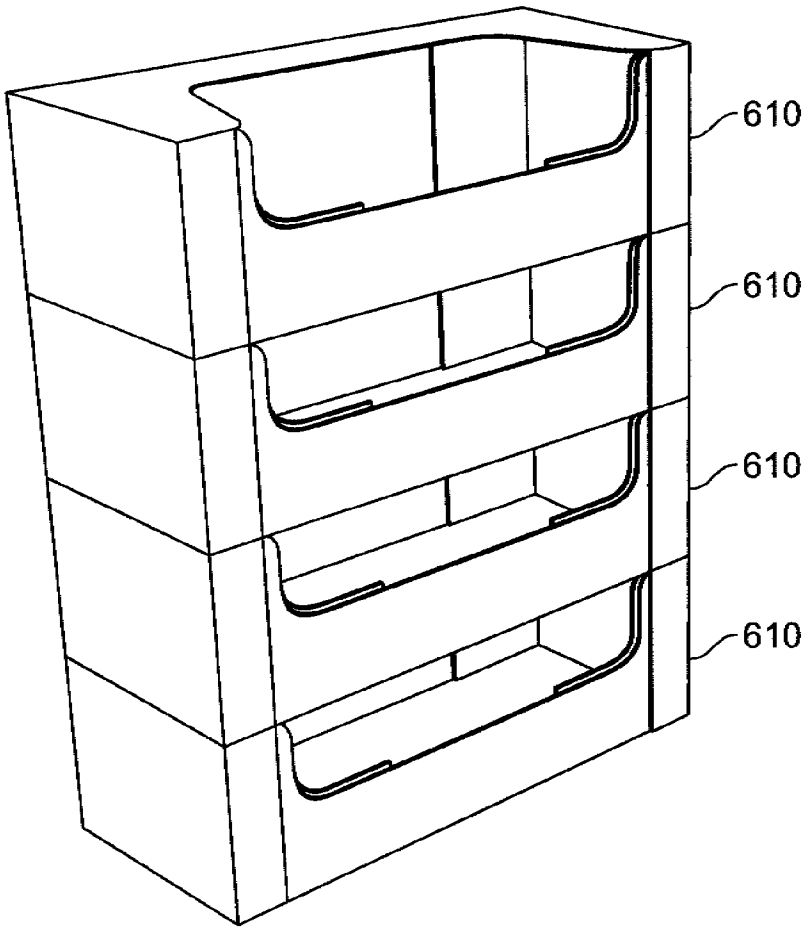
FIG. 21B is a front perspective view of a plurality of stacked containers according to FIGS. 20 and 21A.
Figure 21A:
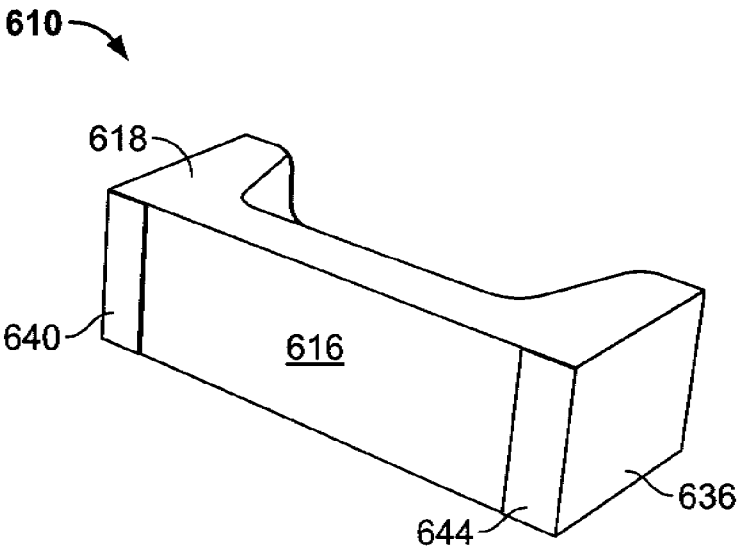
FIG. 21A is a rear perspective view of the container formed from the blank of FIG. 20.
Figure 22:
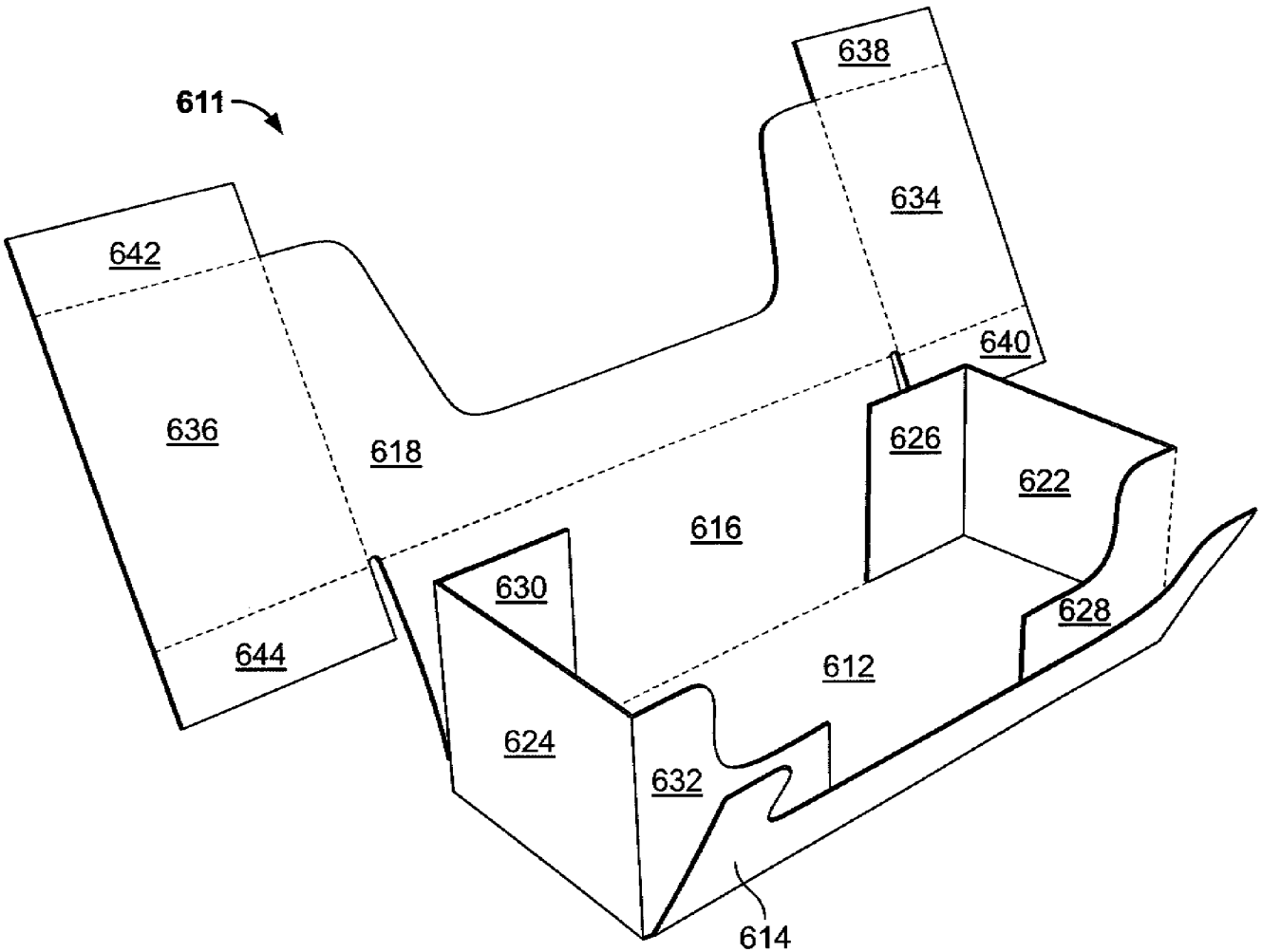
FIG. 22 is a perspective view of a container according to the embodiment of FIGS. 20, 21 A-B, shown partially articulated.
Figure 23:
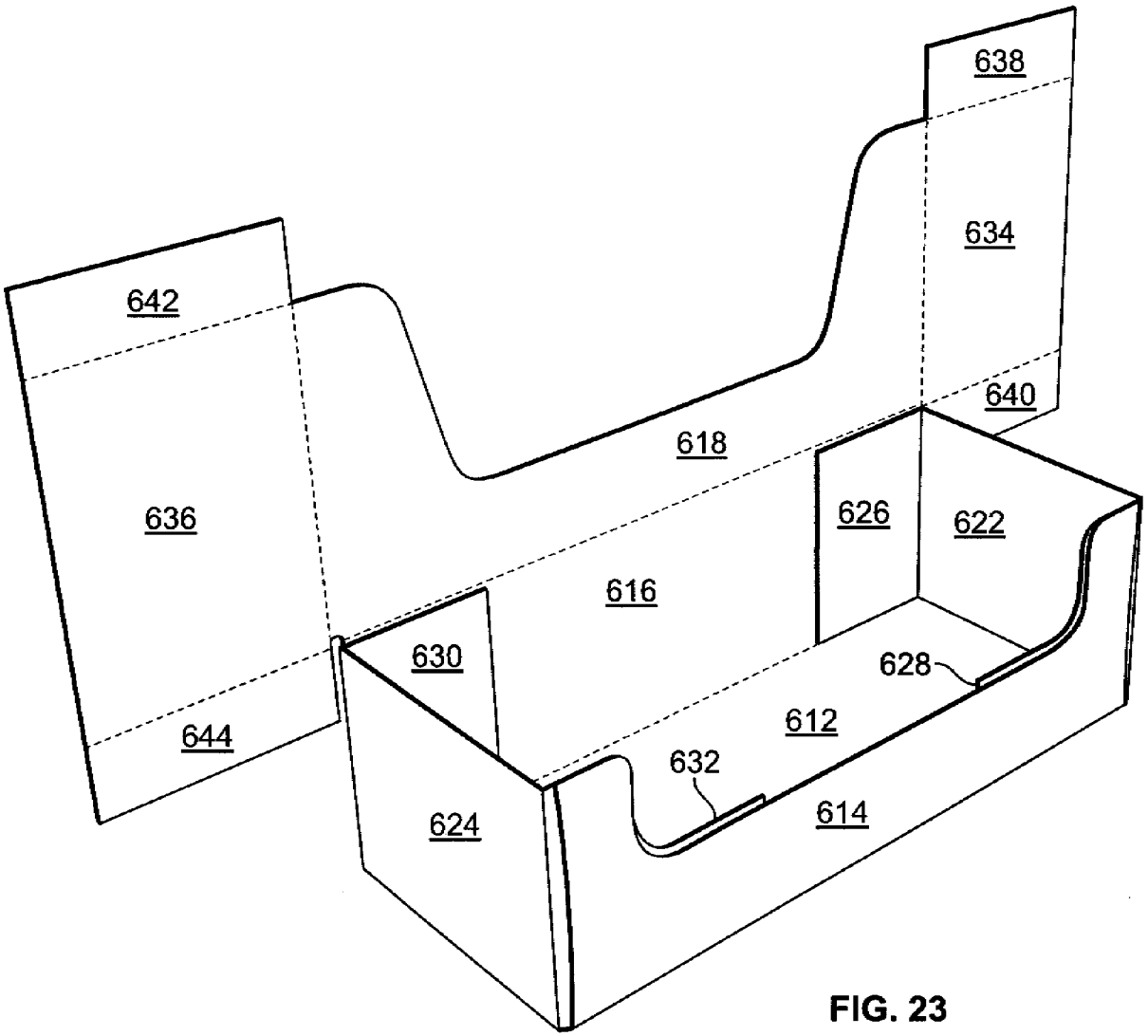
FIG. 23 is a perspective view of a container according to the embodiment of FIG. 22, shown further along the process of articulation.
Figure 24:
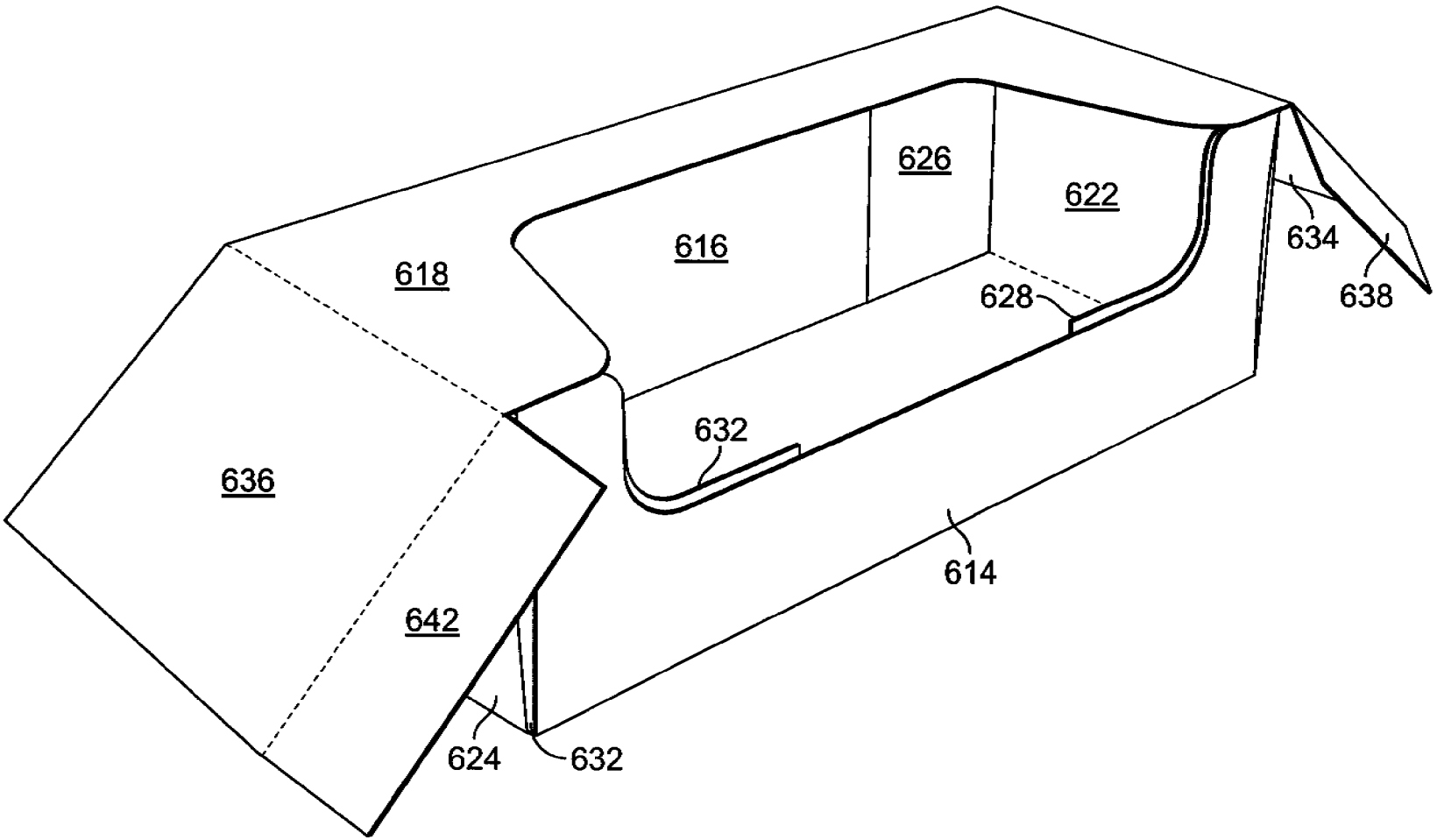
FIG. 24 is a perspective view of the container of FIG. 23, shown further articulated toward closure.

Container 610 is formed from blank 611 (FIG. 20). Blank 611 includes bottom panel 612, front (side) panel 614, rear (side) panel 616, and top panel 618; as well as fold lines 613, 615, and 617. Blank 611 also includes inner end panels 622, 624 (emanating along fold lines 621, 623, respectively) from which interior minor flaps 626, 628, 630, 632 emanate along fold lines 625, 627, 629 and 631, respectively. Outer end panels 634, 636 emanate from top panel 618 along fold lines 633, 635, respectively. Reinforcing flanges 638, 640, 642, 644 emanate from outer end panels 634, 636, along fold lines 637, 639, 641 and 643, respectively. The end edges of rear panel 616 may be concavely bowed (as illustrated), notched, inclined or vertical, while the end edges of front panel 614 may be vertical (as illustrated), inwardly inclined from bottom to top, or concave, because this style of slot configuration may permit ease of removing and ease of stripping the waste material from the designated and created aperture in the blank sheet. As an alternative, rather than the described designated slot, a singular cut including offsets as required may be implemented thereby eliminating a need to remove waste material.

In a typical articulation procedure, first, the product to be contained will be pushed onto blank 611, which will be laid flat on a packaging apparatus. Interior minor flaps 630, 632 will be folded perpendicular to end panel 624, and interior minor flaps 626, 628 will be folded perpendicular to end panel 622. End panels 622, 624 will be folded upwardly perpendicularly to bottom panel 612. Rear (side) panel 616 and front (side) panel 614 will then be folded upwardly perpendicular to bottom panel 612 and be adhesively affixed to exterior surfaces of interior minor flaps 626, 628, 630 and 632. Top panel 618 is then folded down, toward and parallel to bottom panel 612; and outer end panels 634, 636 are folded over and adhesively affixed to exterior surfaces of inner end panels 622, 624, respectively. Finally, reinforcing flanges (minor flaps) 638, 640, 642 and 644 are folded along folds 637, 639, 641 and 643 perpendicular to outer end panels 634, 636, and adhesively adhered to the outer surfaces of front and rear (side) panels 614, 616.

In a ninth variation of the invention (FIGS. 25 and 26A-C), the container is provided with gusseted corner panel structures, instead of minor flaps emanating from the inner end panel side edges, to create a so-called "slotless" container.

Figure 25:
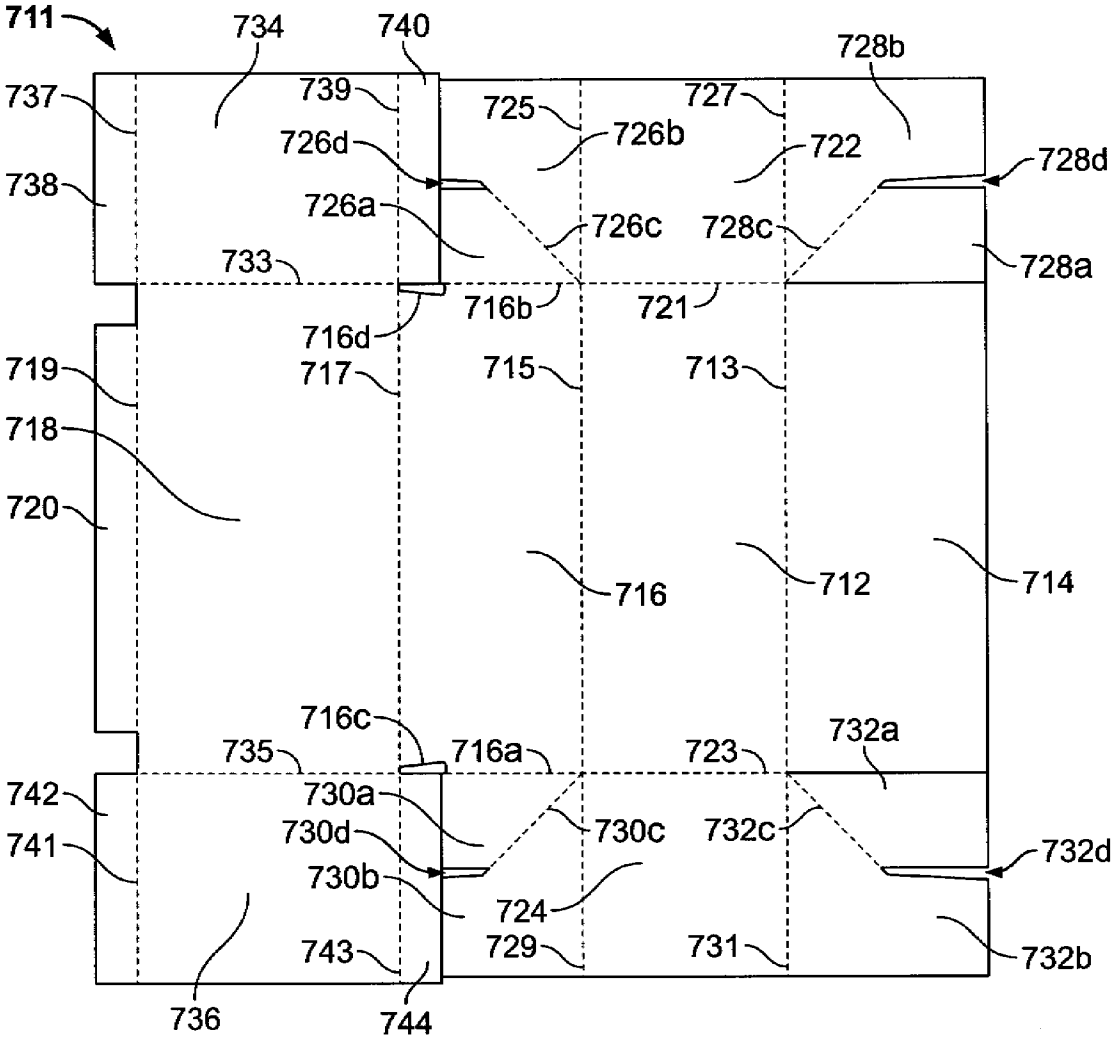
FIG. 25 is a plan view of a blank for a container according to another embodiment of the present invention, in which the container has "slotless" gusseted corners.

Container 710 is formed from blank 711 (FIG. 25). Blank 711 includes bottom panel 712, front (side) panel 714, rear (side) panel 716, top panel 718 and closure flap 720; as well as fold lines 713, 715, 717 and 719. Blank 711 also includes inner end panels 722, 724 (emanating along fold lines 721, 723, respectively) from which interior minor flaps 726, 728, 730, 732 emanate along fold lines 725, 727, 729 and 731, respectively. Outer end panels 734, 736 emanate from top panel 718 along fold lines 733, 735, respectively. Reinforcing flanges 738, 740, 742, 744 emanate from outer end panels 734, 736, along fold lines 737, 739, 741 and 743, respectively. In addition, blank 711 includes gusset panels 726*a*, 726*b*, 730*a*, 730*b*, 728*a*, 728*b*, 732*a* and 732*b*; gusset fold lines 726*c*, 730*c*, 728*c* and 732*c*; and gusset notches 726*d*, 730*d*, 728*d* and 732*d*. Blank 711 also includes clearance diecuts 716*c*, 716*d*.

Figure 26A:
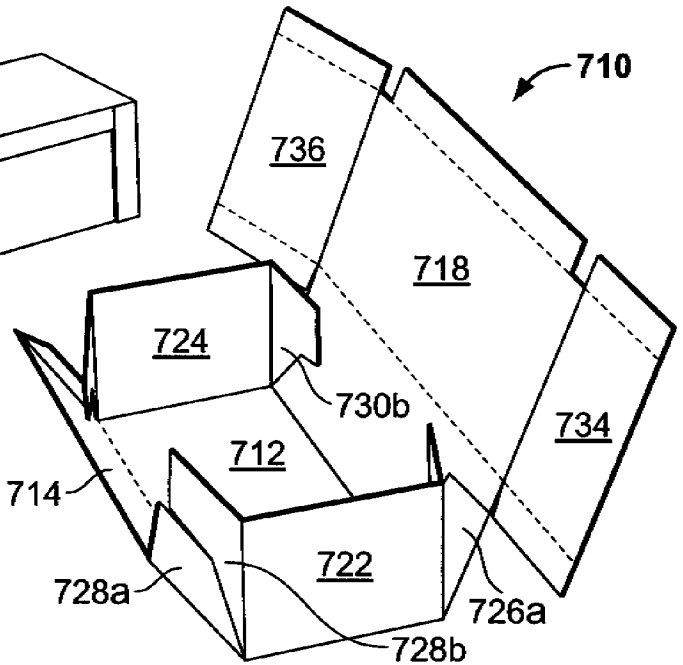
FIG. 26A is a perspective view of a container according to the blank of FIG. 25, shown partially articulated.
Figure 26C:
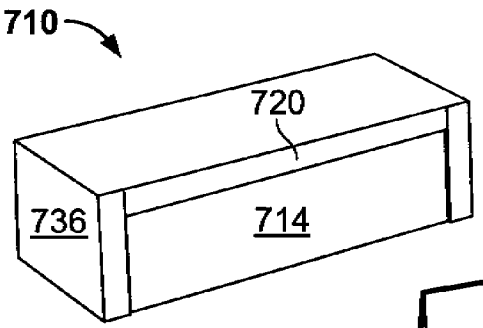
FIG. 26C is a perspective view of the container of FIGS. 26A and 26B, shown fully articulated.
Figure 26B:
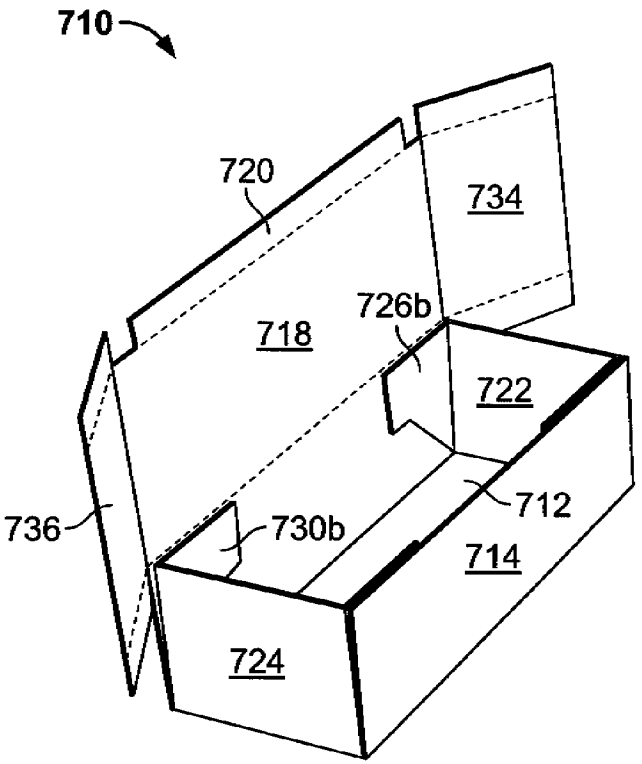
FIG. 26B is a perspective view of the container of FIG. 26A, shown further along the articulation process.

In a typical articulation procedure, first, the product to be contained will be pushed onto blank 711, which will be laid flat on a packaging apparatus. Interior end panels 722, 724 will be folded upwardly perpendicularly to bottom panel 712, while rear (side) panel 716 and front (side) panel 714 are drawn by the corner gusset structures to be folded upwardly perpendicular to bottom panel 712, as shown in FIGS. 26A-26C. At each corner, the respective gusset panel pairs are folded inwardly, so that panels 730*b*, 726*b* are brought parallel to the inside surface of panel 716, capturing and adhesively affixing panels 730*a*, 726*b* between them, respectively; and panels 728*b*, 732*b* are brought parallel to the inside surface of panel 714, capturing and adhesively affixing panels 728*a*, 732*a* between them, respectively.

Top panel 718 is then folded down, toward and parallel to bottom panel 712; and outer end panels 734, 736 are folded over inner end panels 722, 724, respectively. Finally, reinforcing flanges (minor flaps) 738, 740, 742 and 744 are folded along fold lines 737, 739, 741 and 743, respectively, perpendicular to outer end panels 734, 736, and adhesively adhered to the outer surfaces of front and rear (side) panels 714, 716. When top panel 718 is folded down, closure flap 720 is preferably folded to the outside of front panel 714, and adhesively affixed to the outer surface thereof (FIG. 26C). The resultant container 710 is thus a "slotless" container, suitable for the prevention of leakage of liquids (if suitably coated on the inside surfaces thereof), and otherwise suitable for the prevention of leakage of granular or particulate dry materials.

In a tenth variation of the invention (FIGS. 27 and 28A-C), a container similar to that of the embodiment of FIGS. 1-9 is provided with a second closure flap, so that the two closure flaps from the top and front panels overlap to form a reinforced "bar" across the front of the container, at what would otherwise be the weakest corner region, depending upon the proportions, of the sealed container.

Figure 27:
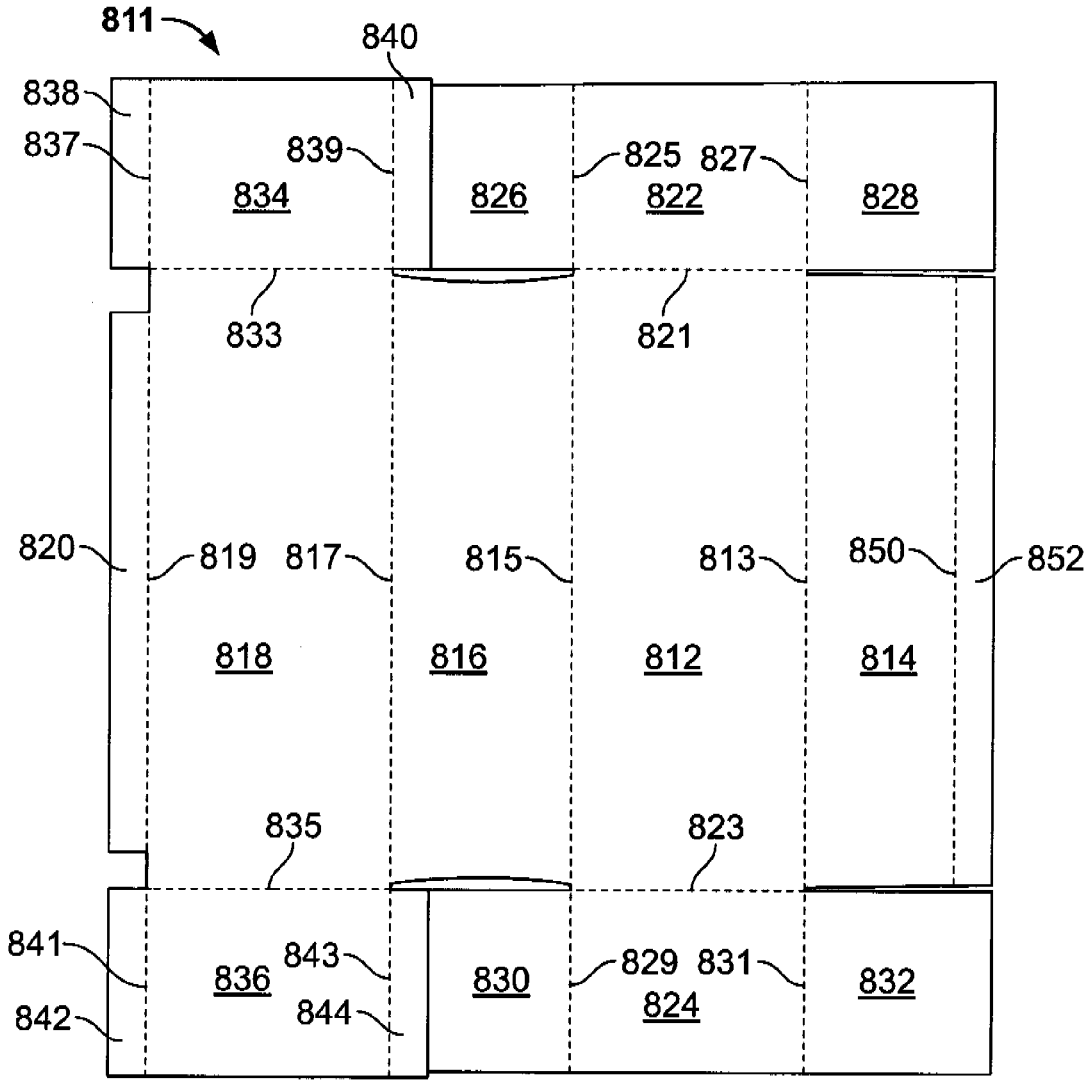
FIG. 27 is a plan view of a blank for a container according to another embodiment of the invention, in which the container as a reinforced transverse closure seal.

Container 810 is formed from blank 811 (FIG. 27). Blank 811 includes bottom panel 812, front (side) panel 814, rear (side) panel 816, top panel 818 and top closure flap 820 and front closure flap 852; as well as fold lines 813, 815, 817, 819 and 850. Blank 811 also includes inner end panels 822, 824 (emanating along fold lines 821, 823, respectively) from which interior minor flaps 826, 828, 830, 832 emanate along fold lines 825, 827, 829 and 831, respectively. Outer end panels 834, 836 emanate from top panel 818 along fold lines 833, 835, respectively. Reinforcing flanges 838, 840, 842, 844 emanate from outer end panels 834, 836, along fold lines 837, 839, 841 and 843, respectively. The end edges of panels 814 and 816 may be vertical. Alternatively, the end edges of the rear panel 816 and front panel 814 preferably may be concavely bowed or notched (as illustrated) or inwardly inclined from bottom to top because this style of slot configuration may permit ease of removing and ease of stripping the waste material from the designated and created aperture in the blank sheet. As an alternative, rather than the described designated slot, a singular cut including offsets as required may be implemented thereby eliminating a need to remove waste material.

In a typical articulation procedure, first, the product to be contained will be pushed onto blank 811, which will be laid flat on a packaging apparatus. Flaps 830, 832 will be folded perpendicular to panel 824, and flaps 826, 828 will be folded perpendicular to panel 822. Panels 822, 824 will be folded upwardly perpendicularly to bottom panel 812. Rear (side) panel 816 and front (side) panel 814 will then be folded upwardly perpendicular to bottom panel 812, as shown in FIGS. 28A-28C. Top panel 818 is then folded down, toward and parallel to bottom panel 812; and outer end panels 834, 836 are folded over inner end panels 822, 824, respectively. Finally, reinforcing flanges (minor flaps) 838, 840, 842 and 844 are folded along fold lines 837, 839, 841 and 843 perpendicular to outer end panels 834, 836, and adhesively adhered to the outer surfaces of front and rear (side) panels 814, 816. When top panel 818 is folded down, closure flap 820 is preferably folded to the outside of front panel 814, and adhesively affixed to the outer surface thereof, while front closure panel 852 is folded inwardly, and affixed to the underside surface of top panel 818, both as shown in FIG. 28C.

The foregoing description and drawings merely explain and illustrate the invention and the invention is not limited thereto, as those skilled in the art who have the disclosure before them will be able to make modifications and variations therein without departing from the scope of the invention.

What is claimed is:

1. A container for the packaging and shipment of articles, articulated from a single monolithically formed blank of container material, the container comprising:

a bottom panel;

a front panel emanating from a front edge region of the bottom panel;

a rear panel emanating from a rear edge of the bottom panel;

a top panel emanating from a top edge region of the rear panel;

first and second inside end panels emanating from end edge regions of the bottom panel;

inner minor flaps emanating from front and rear edge regions of each of the first and second inside end panels;

first and second outside end panels emanating from end edge regions of the top panel;

outer reinforcement flanges emanating from front and rear edge regions of each of the first and second outside end panels, the outer reinforcement flanges each forming a portion of an exterior of the container and having a height substantially equal to a height of the container upon articulation, wherein each of the front outer reinforcement flanges having a front edge adjacent to the front panel and spaced a distance from the corresponding first and second outside end panels;

at least one closure flap emanating from at least one of the top panel and the front panel, wherein the at least one closure flap extends from the front edge of one of the front outer reinforcement flanges to the front edge of the other of the front outer reinforcement flanges, and wherein the at least one closure flap is coplanar with each of the front outer reinforcement flanges; and whereupon articulation of the blank, the top and bottom panels are disposed in parallel, spaced relation to one another; the first and second inside end panels are juxtaposed to and parallel to the first and second outside end panels, respectively; the inner minor flaps are juxtaposed to the inside surfaces of the front and rear panels; and the outer reinforcement flanges are juxtaposed to the outside surfaces of the front and rear panels such that the outer reinforcement flanges that extend from the front edge regions of the first and second outside end panels each form a portion of an exterior of the front panel and the outer reinforcement flanges that extend from the rear edge regions of the first and second outside end panels each form a portion of an exterior of the rear panel for providing a container having reinforced corner regions for enhanced stacking strength.

2. The container according to claim 1, wherein the top and bottom panels are rectangular and have substantially the same dimensions.

3. The container according to claim 1, wherein the first and second inside end panels and the first and second outside end panels are rectangular and have substantially the same dimensions.

4. The container according to claim 1, wherein the at least one closure flap emanates from a forward edge region of the top panel, and upon articulation of the blank, is juxtaposed to an outside of an upper edge region of the front panel.

5. The container according to claim 1, wherein the outer reinforcement flanges have substantially less width than the inner minor flaps.

6. The container according to claim 1, wherein the inner minor flaps, when juxtaposed to the inside surfaces of the front and rear panels, have combined widths that are substantially the same as the respective widths of the front and rear panels.

7. A method for packaging at least one article, using a wraparound style container, articulated from a single monolithically formed blank of container material, the method comprising the steps of:

providing a blank having a bottom panel;

a front panel emanating from a front edge region of the bottom panel;

a rear panel emanating from a rear edge region of the bottom panel;

a top panel emanating from a top edge region of the rear panel;

first and second inside end panels emanating from end edge regions of the bottom panel;

inner minor flaps emanating from front and rear edge regions of each of the first and second inside end panels;

first and second outside end panels emanating from end edge regions of the top panel;

outer reinforcement flanges emanating from front and rear edge regions of each of the first and second outside end panels, the outer reinforcement flanges each forming a portion of an exterior of the container and having a height substantially equal to a height of the container upon articulation, wherein each of the front outer reinforcement flanges having a front edge adjacent to the front panel and spaced a distance from the corresponding first and second outside end panels;

at least one closure flap emanating from at least one of the top panel and the front panel, wherein the at least one closure flap extends from the front edge of one of the front outer reinforcement flanges to the front edge of the other of the front outer reinforcement flanges, and wherein the at least one closure flap is coplanar with each of the front outer reinforcement flanges;

positioning the at least one article to be packaged in overlying relation to the bottom panel of the blank;

folding the inner minor flaps to positions at least oblique with respect to their respective first and second inside end panels;

folding the first and second inside end panels to positions at least oblique with respect to the bottom panel;

folding the front panel to an upright position relative to the bottom panel;

folding the rear panel to an upright position relative to the bottom panel;

folding the top panel to a position substantially parallel to the bottom panel;

folding the first and second outside end panels to positions juxtaposed to and overlying the first and second inside end panels;

folding the outer reinforcement flanges to positions juxtaposed to and overlying the front and rear panels and affixing the outer reinforcement flanges thereto such that the outer reinforcement flanges that extend from the front edge regions of the first and second outside end panels each form a portion of an exterior of the front panel and the outer reinforcement flanges that extend from the rear edge regions of the first and second outside end panels each form a portion of an exterior of the rear panel; and sealing the container by at least one closure flap to at least one of the front panel and the top panel.

8. The method according to claim 7, wherein the step of positioning the at least one article to be packaged in overlying relation to the bottom panel of the blank is performed prior to the articulation of any of the panels of the blank.

9. The method according to claim 7, wherein the step of positioning the at least one article to be packaged in overlying relation to the bottom panel of the blank is performed, after the step of folding the inner minor flaps emanating from the rear edge regions of the first and second inside end panels, but prior to the step of folding the inner minor flaps emanating from the front edge regions of the first and second inside end panels.

10. The method according to claim 7, further comprising the step of providing top and bottom panels that are rectangular and have substantially the same dimensions.

11. The method according to claim 7, further comprising the steps of providing at least one closure flap emanating from a forward edge region of the top panel, and juxtaposing the at least one closure flap to an outside surface of an upper edge region of the front panel.

12. The method according to claim 7, further comprising the step of providing the outer reinforcement flanges with substantially less width than the inner minor flaps.

13. The method according to claim 7, further comprising the step of providing the inner minor flaps, when juxtaposed to the inner surfaces of the front and rear panels, with combined widths that are substantially less than the respective widths of the front and rear panels.

* * * * *